US009950518B2

(12) United States Patent
Yamada et al.

(10) Patent No.: US 9,950,518 B2
(45) **Date of Patent: *Apr. 24, 2018**

(54) LIQUID EJECTING APPARATUS AND LIQUID EJECTING SYSTEM

(71) Applicant: Seiko Epson Corporation, Tokyo (JP)

(72) Inventors: Tomonori Yamada, Shiojiri (JP); Toru Matsuyama, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/336,973

(22) Filed: Oct. 28, 2016

(65) Prior Publication Data

US 2017/0120639 A1 May 4, 2017

(30) Foreign Application Priority Data

Oct. 30, 2015 (JP) ..... 2015-214260

(51) Int. Cl.

| | |
|---|---|
| ***B41J 29/38*** | (2006.01) |
| ***B41J 2/045*** | (2006.01) |
| ***B41J 29/02*** | (2006.01) |
| ***B41J 29/13*** | (2006.01) |

(52) U.S. Cl.

CPC ..... *B41J 2/04541* (2013.01); *B41J 2/04548* (2013.01); *B41J 2/04581* (2013.01); *B41J 2/04588* (2013.01); *B41J 2/04593* (2013.01); *B41J 2/04596* (2013.01); *B41J 29/02* (2013.01); *B41J 29/13* (2013.01); *B41J 29/38* (2013.01)

(58) Field of Classification Search

CPC ..... B41J 2/04541; B41J 29/38; B41J 29/13; B41J 29/02; B41J 2/04548; B41J 2/04593; B41J 2/04588; B41J 2/04581; B41J 2/04596

See application file for complete search history.

(56) References Cited

U.S. PATENT DOCUMENTS

| | | | |
|---|---|---|---|
| 6,239,879 B1 | 5/2001 | Hay | |
| 9,139,028 B1 | 9/2015 | Otsuka et al. | |
| 9,318,898 B2 | 4/2016 | John | |
| 2013/0026848 A1* | 1/2013 | Ito | B60L 11/182 307/104 |

(Continued)

FOREIGN PATENT DOCUMENTS

| | | |
|---|---|---|
| JP | 2000-058356 A | 2/2000 |
| JP | 2001-310457 A | 11/2001 |

(Continued)

*Primary Examiner* — Yaovi M Ameh

(74) *Attorney, Agent, or Firm* — Harness, Dickey & Pierce, P.L.C.

(57) ABSTRACT

A liquid ejecting apparatus includes: a liquid ejecting section that ejects liquid in response to a drive signal; a drive signal generation circuit that generates the drive signal by using a second frequency band including at least a part of a first frequency band; a non-contact power transmission circuit that transmits power in a non-contact manner by using the first frequency band; and a control circuit that controls the drive signal generation circuit and the non-contact power transmission circuit, in which the control circuit restricts the generation of the drive signal by the drive signal generation circuit in a case where the non-contact power transmission circuit has transmitted the power.

20 Claims, 14 Drawing Sheets

(56) References Cited

U.S. PATENT DOCUMENTS

| | | | | |
|---|---|---|---|---|
| 2013/0286691 | A1 | 10/2013 | Matthews | |
| 2015/0061401 | A1 | 3/2015 | Nago | |
| 2015/0062214 | A1 | 3/2015 | Kashimura et al. | |
| 2015/0062220 | A1 | 3/2015 | Kashimura et al. | |
| 2017/0120578 | A1* | 5/2017 | Yamada | B41J 29/13 |
| 2017/0120580 | A1* | 5/2017 | Yamada | B41J 2/04541 |

FOREIGN PATENT DOCUMENTS

| | | | |
|---|---|---|---|
| JP | 2004-262091 | A | 9/2004 |
| JP | 2015-063119 | A | 4/2015 |

* cited by examiner

LIQUID EJECTING APPARATUS AND LIQUID EJECTING SYSTEM

This application claims priority to Japanese Patent Application No. 2015-214260 filed on Oct. 30, 2015. The entire disclosure of Japanese Patent Application No. 2015-214260 is hereby incorporated herein by reference.

BACKGROUND

1. Technical Field

The present invention relates to a liquid ejecting apparatus and a liquid ejecting system that have a liquid ejecting function of ejecting liquid as in an ink jet printer and a power transmission function of transmitting power in a non-contact manner with another apparatus.

2. Related Art

In recent years, a liquid ejecting apparatus such as an ink jet printer using a piezoelectric element has been developed for a further decrease in size and power consumption, and a technique of generating a drive waveform of a drive signal to be applied to the piezoelectric element by high-frequency switching (from 1 to 8 MHz, for example) has been distributed (JP-A-2015-63119, for example). The liquid ejecting apparatus disclosed in JP-A-2015-63119 generates the waveform of the drive signal by applying a technology of a digital amplifier and using a frequency band of high-frequency switching.

In contrast, there is a high demand of wireless power supply as well as the demand of the decrease in size for a personal computer (PC), a printer, and the like in response to a demand of high degrees of freedom in carrying and installing such OA devices. For such OA devices, development of a power transmission technology using a frequency band of 6.78 MHz has been advanced (JP-A-2004-262091, JP-A-2001-310457, and JP-A-2000-58356, for example).

JP-A-2004-262091 discloses a technology of transmitting power from a printer to another electronic device in a non-contact manner. JP-A-2001-310457 discloses a technology of transmitting power in a printer by non-contact power supply. JP-A-2000-58356 discloses a technology of transmitting power from a printer to a detachable component in a non-contact manner.

Incidentally, a liquid ejecting apparatus that has a small size and a high power saving property and is highly freely carried and installed can be inevitably realized by combination of the technology of generating the drive signal disclosed in JP-A-2015-63119 and the technology of supplying power in the wireless manner disclosed in JP-A-2004-262091, JP-A-2001-310457, and JP-A-2000-58356. However, all the technologies use a high-frequency band, and there is a possibility that if it is attempted to realize such a liquid ejecting apparatus simply by combining two technologies, a problem of electrical interference such as resonance occurs due to usage of partially overlapping frequencies and the liquid ejecting apparatus does not operate normally.

Here, a case is exemplified in which the drive signal is affected by an electromagnetic wave at a frequency band used for the wireless power supply, the drive waveform of the drive signal is disrupted, a non-ejection error or an erroneous ejection of liquid occurs as a result of the disruption of the drive waveform, and printing quality deteriorates, as an example in which the liquid ejecting apparatus does not operate normally. Another case is also exemplified in which the wireless power supply is affected by electromagnetic wave noise generated at the frequency band of the high-frequency switching at the time of generating the waveform of the drive signal, which causes a problem in charging, such as excessive or insufficient charging, as an example in which the liquid ejecting apparatus does not operate normally.

Although JP-A-2015-63119 discloses a technology related to a circuit (digital amplifier) that performs high-frequency switching on an amplifier circuit that is simply used for driving ejection, JP-A-2015-63119 does not disclose any problems caused by interference of frequency bands used by both wireless power supply configurations that are present together and countermeasures for the problems. Although JP-A-2004-262091, JP-A-2001-310457, and JPA-2000-58356 disclose a technology of supplying power in a wireless manner in a printer, JP-A-2004-262091, JP-A-2001-310457, and JP-A-2000-58356 do not disclose interference with other high-frequency switching circuits, problems caused by the interference, and countermeasures for the problems.

SUMMARY

An advantage of some aspects of the invention is to provide a liquid ejecting apparatus and a liquid ejecting system capable of suppressing power transmission from being affected by electrical interference of electromagnetic noise caused when a drive signal generation circuit generates a drive signal and stably transmitting power.

Hereinafter, description will be given of mechanisms for solving the aforementioned problems and advantages thereof.

According to an aspect of the invention, there is provided a liquid ejecting apparatus including: a liquid ejecting section that ejects liquid in response to a drive signal; a drive signal generation circuit that generates the drive signal by using a second frequency band including at least a part of a first frequency band; a non-contact power transmission circuit that transmits power in a non-contact manner by using the first frequency band; and a control circuit that controls the drive signal generation circuit and the non-contact power transmission circuit, in which the control circuit restricts the generation of the drive signal by the drive signal generation circuit in a case where the non-contact power transmission circuit has transmitted power.

With such a configuration, the liquid ejecting section ejects the liquid in response to the drive signal generated by the drive signal generation circuit by using the second frequency band including at least a part of the first frequency band. The non-contact power transmission circuit performs the power transmission (power sending or power receiving, for example) by using the first frequency band in a non-contact manner. The drive signal generation circuit and the non-contact power transmission circuit are controlled by the control circuit. At this time, the control circuit restricts the generation of the drive signal by the drive signal generation circuit in a case where the non-contact power transmission circuit has transmitted the power. Therefore, the power transmission is performed with priority, and it is possible to suppress the power transmission from being affected by electrical interference caused by electromagnetic noise caused when the drive signal generation circuit generates the drive signal and to stably transmit power.

It is preferable that the liquid ejecting apparatus further includes: a case body that surrounds the drive signal generation circuit and the non-contact power transmission circuit and includes a first surface and a second surface that faces the first surface, that the drive signal generation circuit is arranged at a position closer to the first surface than to the second surface, and that the non-contact power transmission circuit is arranged at a position closer to the second surface than to the first surface.

With such a configuration, the drive signal generation circuit is arranged at a position closer to the first surface than to the second surface in the case body, and the non-contact power transmission circuit is arranged at a position closer to the second surface than to the first surface in the case body. Therefore, the drive signal generation circuit and the non-contact power transmission circuit are located so as to be separate from each other in the case body, and it is possible to suppress electrical interference therebetween.

It is preferable that the non-contact power transmission circuit transmits the power from an apparatus outside the liquid ejecting apparatus to the liquid ejecting apparatus.

With such a configuration, the non-contact power transmission circuit transmits the power from the apparatus outside the liquid ejecting apparatus to the liquid ejecting apparatus. Therefore, it is possible to supply the power from the apparatus outside the liquid ejecting apparatus to the liquid ejecting apparatus in the non-contact manner.

It is preferable that the non-contact power transmission circuit transmits the power from the liquid ejecting apparatus to an apparatus outside the liquid ejecting apparatus.

With such a configuration, the non-contact power transmission circuit transmits the power from the liquid ejecting apparatus to the apparatus outside the liquid ejecting apparatus. Therefore, it is possible to supply the power from the liquid ejecting apparatus to the apparatus outside the liquid ejecting apparatus in the non-contact manner.

It is preferable that the drive signal generation circuit includes an amplifier circuit using a digital amplifier.

With such a configuration, it is possible to avoid interference (resonance, for example) even in a high-frequency band of the digital amplifier.

It is preferable that the second frequency band includes a frequency in a band from 1 to 8 MHz.

With such a configuration, it is possible to avoid interference such as resonance even by using the first frequency band for power transmission, at least a part of which is included in the second frequency band, in a case where the second frequency band necessary for generating the drive signal to be provided to the liquid ejecting section includes a band from 1 to 8 MHz. In a case where it is desired to steeply change the waveform of the drive signal, a higher frequency band in the second frequency band including 1 to 8 MHz may be used, and in other cases, a lower frequency band than the frequency may be used. At this time, it is possible to avoid interference such as resonance by partially restricting the second frequency band in a case where the steep waveform is not required and in a case where a slight decrease in precision of the steep waveform is allowable.

It is preferable that under the restriction, the drive signal is generated without using the first frequency band.

With such a configuration, the drive signal generation circuit uses a frequency band excluding the first frequency band in the second frequency band to generate the drive signal in a case where the control circuit restricts the generation of the drive signal.

It is preferable that under the restriction, the frequency band used for generating the drive signal is switched.

With such a configuration, the generation of the drive signal by the drive signal generation circuit is restricted by switching the frequency band used for generating the drive signal. Therefore, it is possible to stably supply the power.

It is preferable that under the restriction, the generation of the drive signal is stopped.

With such a configuration, the generation of the drive signal is restricted by stopping the generation of the drive signal by the drive signal generation circuit. Therefore, it is possible to suppress electrical interference between the drive signal generation circuit and the non-contact power transmission circuit, to suppress deterioration of printing quality due to electrical interference, and to stably transmit power.

It is preferable that a draft mode in which dots formed by the liquid ejecting section ejecting the liquid have first resolution and a high-definition mode in which the dots have second resolution that is higher than the first resolution are provided, and that the control circuit restricts the generation of the drive signal by the drive signal generation circuit in the draft mode and does not restrict the generation of the drive signal in the high-definition mode in a case where the non-contact power transmission circuit has transmitted the power.

With such a configuration, the control circuit restricts the generation of the drive signal by the drive signal generation circuit in the draft mode and does not restrict the generation of the drive signal in the high-definition mode in a case where the non-contact power transmission circuit has transmitted the power. Therefore, it is possible to relatively avoid unnecessary restriction of the drive signal generation circuit, to suppress deterioration of printing quality, and to stably transmit power.

According to another aspect of the invention, there is provided a liquid ejecting system including: the liquid ejecting apparatus as described above; and a power supply device, in which the liquid ejecting apparatus includes a power receiving section, and the power supply device includes a power sending section that sends power to the power receiving section in a non-contact manner.

With such a configuration, the liquid ejecting apparatus can receive the power from the power sending section of the power supply device by the power receiving section in the non-contact manner. Therefore, it is possible to stably transmit power form the power supply device to the liquid ejecting apparatus. For example, it is possible to stably charge the liquid ejecting apparatus.

According to another aspect of the invention, there is provided a liquid ejecting system including: the liquid ejecting apparatus as described above; and an electronic device, in which the liquid ejecting apparatus includes a power sending section in the non-contact power transmission circuit, and the electronic device includes a power receiving section that receives power supply from the power sending section in a non-contact manner.

With such a configuration, it is possible to transmit the power from the power sending section of the liquid ejecting apparatus to the power receiving section of the electronic device in the non-contact manner. Therefore, it is possible to stably transmit the power from the liquid ejecting apparatus to the electronic device. For example, it is possible to stably charge the electronic device.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Hereinafter, description will be given of a first embodiment of a liquid ejecting apparatus and a liquid ejecting system with reference to drawings.

Figure 1:
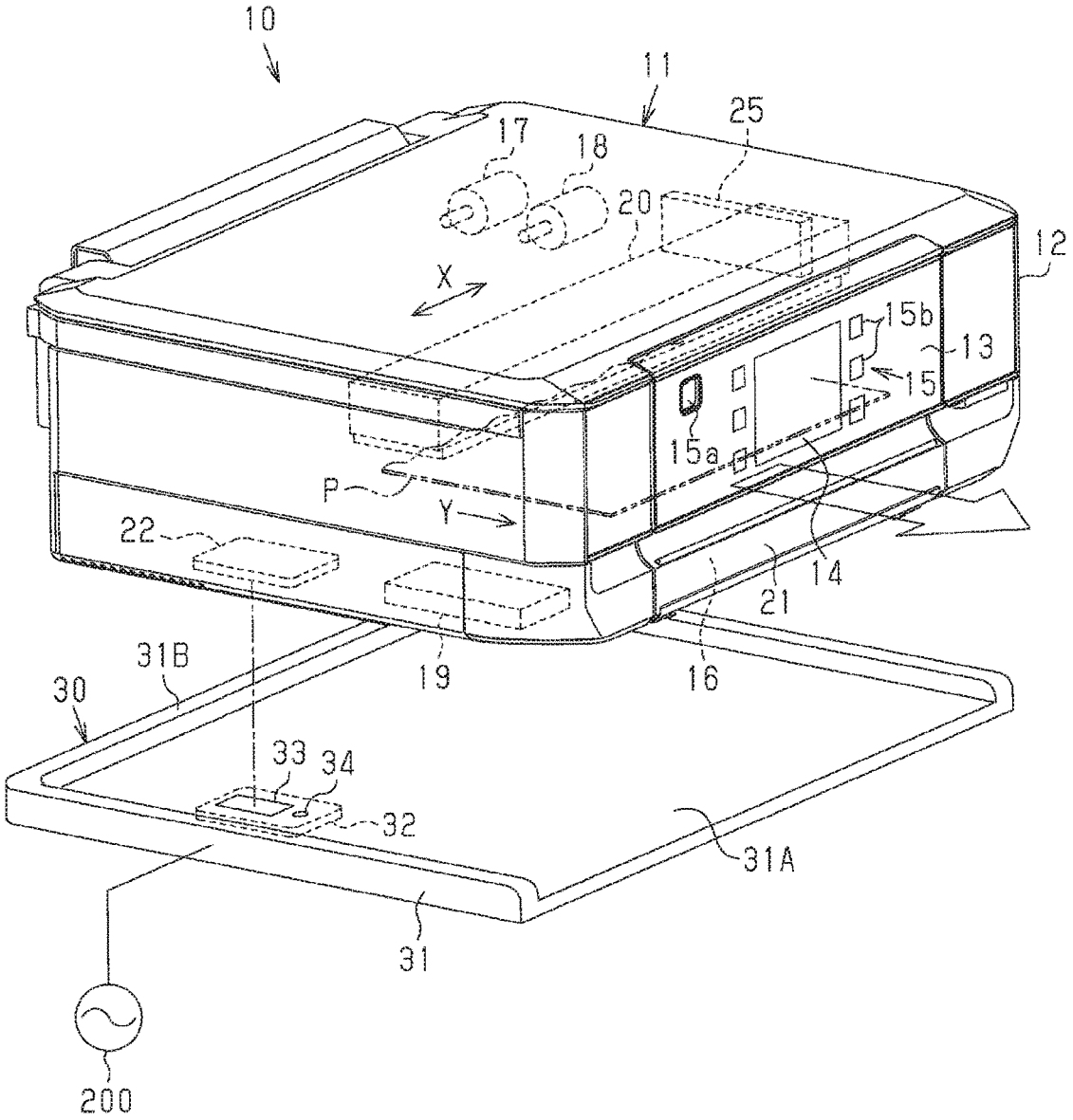
FIG. 1 is a perspective view illustrating a liquid ejecting system with a charging function according to a first embodiment.

As illustrated in FIG. 1, a liquid ejecting system 10 with a non-contact charging function include a printer 11 as an example of the liquid ejecting apparatus and a power supply device 30 with a non-contact power supply function of supplying power to the printer 11 in a non-contact manner. The printer 11 is an ink jet printer that ejects ink as an example of liquid. The power supply device 30 includes a tray-shaped pad 31 for power supply that includes an installation surface 31A on which the printer 11 can be installed. The power supply device 30 includes a power sending unit 32 that can supply power of a predetermined voltage, which is obtained by converting an AC voltage input from a commercial AC power source 200 into a DC voltage, in a non-contact manner. In addition, the printer 11 includes a power receiving unit 22 at such a position that the power receiving unit 22 faces the power sending unit 32 in a state of being installed on the pad 31. If the printer 11 is installed on the installation surface 31A of the pad 31, then the power sending unit 32 on the side of the power supply device 30 supplies power to the power receiving unit 22 on the side of the printer 11 in a non-contact manner. That is, the printer 11 receives the power from the power supply device 30 in a non-contact manner. In the embodiment, the power supply device 30 corresponds to an example of "the apparatus outside the liquid ejecting apparatus", which transmits power to the liquid ejecting apparatus.

The printer 11 illustrated in FIG. 1 includes a case body 12 with a substantially rectangular parallelepiped shape and an operation panel 13 that is provided on a front surface (the right surface in FIG. 1) of the case body 12 and is used by a user to perform input operations. The operation panel 13 includes a display unit 14 formed of a liquid crystal panel or the like and an operation unit 15 formed of a plurality of operation switches. The operation unit 15 includes a power switch 15*a* that is operated for turning on and off a power source of the printer 11 and a selection switch 15*b* that is operated for selecting a desired item in a menu screen displayed on the display unit 14.

As illustrated in FIG. 1, a feeding cassette 16 that can accommodate a plurality of media P, such as sheets, therein is detachably attached to (freely inserted into or pulled out from) a lower position of the operation panel 13 on the front surface of the case body 12. The plurality of media P accommodated in the feeding cassette 16 is sent one by one by a feeding roller (a pick-up roller, for example) which is not shown in the drawing. The sent media P are transported in a transport direction Y along a predetermined transport path by a transport mechanism (not shown) provided with at least one of a transport roller and a transport belt for transporting media. As illustrated in FIG. 1, a feeding motor 17 as a power source of the aforementioned feeding roller and a transport motor 18 as a power source for the transport mechanism are disposed at one end (the right end in the example in FIG. 1) in a width direction X in the case body 12. The transport motor 18 outputs, to the transport mechanism, the power to transport the media P as targets of liquid (ink) ejection from an ejecting section D (see FIG. 4) of a liquid ejecting head 20.

In the case body 12, the liquid ejecting head 20 is bridged in the case body 12 so as to extend in a main scanning direction X that intersects the transport direction Y. The liquid ejecting head 20 is a line head, for example, has a dimension that is slightly longer in the main scanning direction X than the width of the media P with an expected maximum width, and includes a plurality of nozzles 27*a* (see FIG. 4) that can eject ink droplets at the same time over the entire region in the width direction of the media P. The liquid ejecting head 20 ejects the ink droplets at a specific time interval toward a linear range over the entire region of the media P, which are transported in the transport direction Y at a predetermined transport speed, in the width direction thereof as an ejection range. Images and documents are printed on the media P by ink dots formed by the ink droplets landed on the surfaces of the media P. The media P after the printing are discharged in the direction represented by the white arrow in FIG. 1 from a discharge port that is exposed in an opened state of a cover 21 provided at a front portion of the feeding cassette 16 accommodated in the case body 12 so as to be freely opened and closed. The discharged media P after the printing are accumulated on a stacker (medium receiving tray) extending from the lower side of the discharge port to the front side, for example, which is not shown in the drawing.

The printer 11 according to the embodiment includes a built-in rechargeable battery 19. The printer 11 receives power from the power supply device 30 in a non-contact manner at timing when charging is allowed in a state of being installed on the pad 31 of the power supply device 30 illustrated in FIG. 1, and the battery 19 is charged with the received power. The pad 31 includes a built-in power sending unit 32 at a predetermined position on the installation surface 31A on which the printer 11 is installed, in a state where at least a part of a power sending section 33 and a communication section 34 are exposed. A positioning protrusion 31B capable of positioning the printer 11 at a predetermined position on the installation surface 31A projects from a peripheral edge portion surrounding the installation surface 31A of the pad 31 in a state of extending along at least a partial side of the installation surface 31A.

The power receiving unit 22 provided at the bottom of the printer 11 faces the power sending unit 32 on the side of the pad 31 in a non-contact manner so as to be able to supply power in a wireless manner in a state where the printer 11 is installed on the pad 31. In this example, the power receiving unit 22 is arranged on a side of a bottom of one of both ends in the case body 12 in the width direction X (main scanning direction X).

Figure 2:
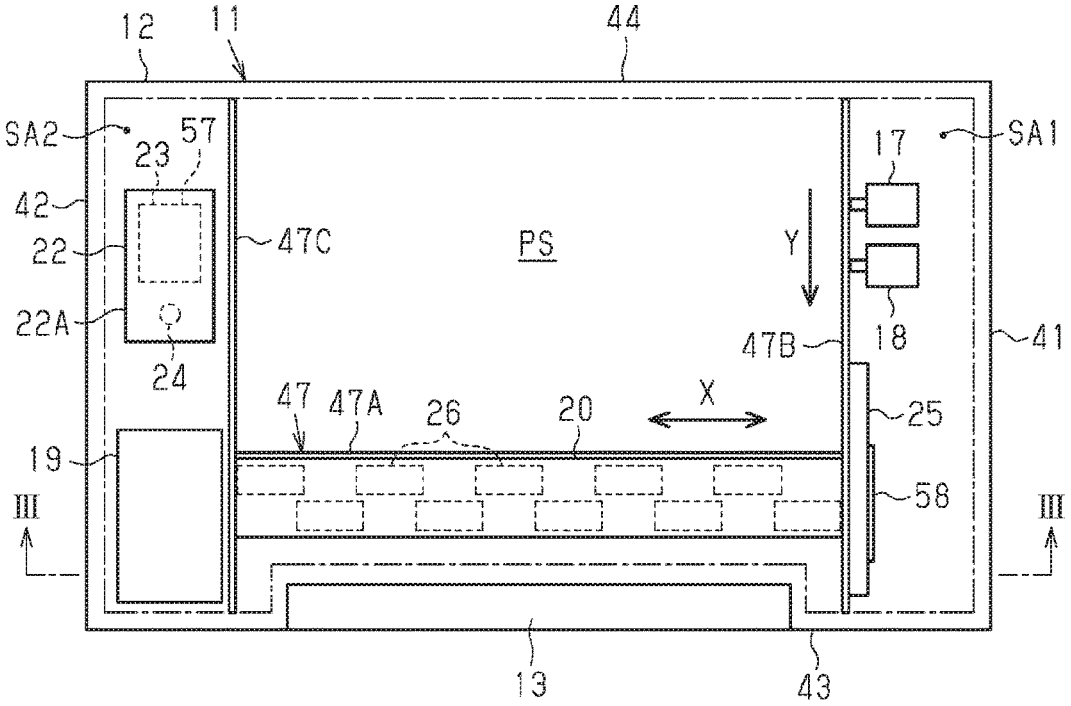
FIG. 2 is a planar sectional view schematically illustrating a layout of components in a printer taken along the line II-II in FIG. 3.
Figure 3:
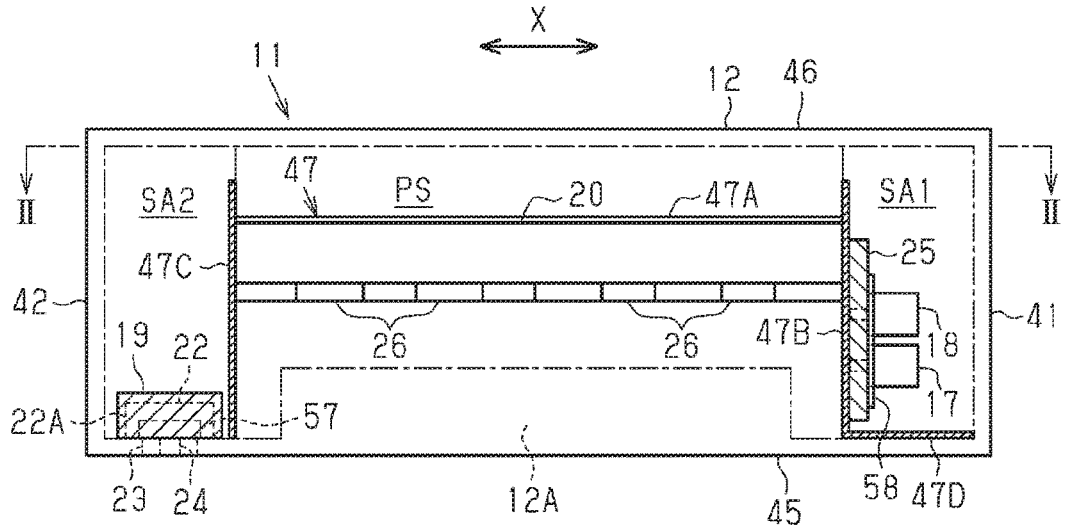
FIG. 3 is a front sectional view schematically illustrating the layout of the components in the printer taken along the line III-III in FIG. 2.

As illustrated FIGS. 2 and 3, the power receiving unit 22 includes a power receiving section 23 that is exposed at a position, at which the power receiving section faces the power sending section 33 on the side of the power sending unit 32, at the bottom of the printer 11 in a state where the printer 11 is installed on the installation surface 31A of the power supply device 30, and a communication section 24 that is exposed at a position at which the communication section 24 faces the communication section 34 on the side of the power sending unit 32. As described above, the liquid ejecting system 10 according to the embodiment includes the power supply device 30 provided with the power sending unit 32 and the printer 11 provided with the power receiving unit 22.

As illustrated in FIG. 1, the case body 12 includes therein a circuit substrate 25 on which various circuit units including a drive signal generation circuit 58 (see FIGS. 6 and 7) that generates a drive signal to be transmitted for causing the liquid ejecting head 20 to eject ink droplets are mounted. In this example, the circuit substrate 25 is arranged at the other end on the opposite side of the one end, at which the power receiving unit 22 is arranged, in the longitudinal direction (width direction X) of the liquid ejecting head 20 in the case body 12. That is, the circuit substrate 25 on which the drive signal generation circuit 58 is mounted and the power receiving unit 22 are arranged at both ends (in both side regions) on outer sides beyond both longitudinal ends of the liquid ejecting head 20 in the width direction X in the case body 12.

As illustrated in FIGS. 2 and 3, the case body 12 of the printer 11 has a first surface 41 (right surface) and a second surface 42 (left surface) that face each other in the width direction X and a third surface 43 (front surface) and a fourth surface 44 (rear surface) that face each other in the transport direction Y (front/rear direction) as exterior wall surfaces. Furthermore, the case body 12 includes a fifth surface 45 (bottom surface) and a sixth surface 46 (top surface) that face each other in a height direction (vertical direction in FIG. 3) of the printer 11. The circuit substrate 25 (drive signal generation circuit 58) is arranged at a position closer to the first surface 41 than to the second surface 42 in the case body 12. The power receiving unit 22 (non-contact power receiving circuit 57) is arranged at a position closer to the second surface 42 than to the first surface 41 in the case body 12.

As illustrated in FIGS. 2 and 3, the center at the area corresponding to the expected maximum width of the media P in the width direction X in the case body 12 is used as a printing space PS where the liquid ejecting head 20, the transport mechanism of the media P (transport roller and the like), and the like are arranged and transport of the media P and printing on the media P are performed. The lower portion of the printing space PS in the case body 12 is an accommodation recessed portion 12A that can accommodate the feeding cassette 16 therein. In addition, a first accommodation space SA1 (first side region SA1) and a second accommodation space SA2 (second side region SA2) with rectangular parallelepiped shapes that extend in the transport direction Y and are slightly narrow in the width direction X are provided on both sides of the printing space PS in the width direction X, that is, on both sides of the longitudinal direction (width direction X) with the liquid ejecting head 20 interposed therebetween in the case body 12.

As illustrated in FIGS. 2 and 3, a metal frame 47 that supports various components and the like is provided in the case body 12. A material of the frame 47 is iron-based metal or aluminum-based metal, for example. The liquid ejecting head 20 is supported at the metal frame 47 that is arranged in the case body 12. The circuit substrate 25 on which the drive signal generation circuit 58 is mounted and the power receiving unit 22 provided with the non-contact power receiving circuit 57 are arranged on opposite sides with the frame 47 interposed therebetween.

The frame 47 includes a main frame section 47A that is transversely bridged so as to extend in the width direction X in the printing space PS, and right and left side frame sections 47B and 47C with plate shapes that are provided so as to stand from the bottom surface (inner wall bottom surface) of the case body 12 and extend in a direction (a direction parallel to the transport direction Y) that intersects the longitudinal direction (transversely bridged direction) of the main frame section 47A. The right and left side frame sections 47B and 47C are respectively coupled to the main frame section 47A at both ends in the longitudinal direction. The right and left side frame sections 47B and 47C section the case body 12 into the printing space PS, the first accommodation space SA1, and the second accommodation space SA2. In the embodiment, the main frame section 47A forms an example of the "first frame section", the side frame section 47B on the right side forms an example of the "second frame section", and the side frame section 47C on the left side forms an example of the "third frame section".

In the printing space PS, the liquid ejecting head 20 is transversely bridged in a state of being supported by the main frame section 47A. The first accommodation space SA1 accommodates a power source for a supply and transport system such as the feeding motor 17 and the transport motor 18, a power transmission mechanism (gear train and the like) that transmits the power of the transport motor 18 to the transport mechanism, an encoder that detects the amount of rotation of the transport motor 18, and the like (all of which are not shown in the drawing) in a state of being supported by the side frame section 47B, for example.

The circuit substrate 25 is arranged in the first accommodation space SA1 in the case body 12 in a state of being supported by the side frame section 47B, for example. The power receiving unit 22 is arranged in the second accommodation space SA2 in the case body 12 in a state of being assembled with the metal bottom plate section that forms the frame 47, which is not shown in the drawing. More specifically, the circuit substrate 25 is accommodated in the first accommodation space SA1 in the same manner as supply and transport system motors 17 and 18. The power receiving unit 22 is accommodated in the second accommodation space SA2 in the same manner as the battery 19. As described above, the circuit substrate 25 and the power receiving unit 22 are positioned at outer sides beyond both end surfaces of the liquid ejecting head 20 in the width direction X, and are respectively arranged on both sides with the liquid ejecting head 20 interposed therebetween in the width direction X so as to be separate from each other at a distance that is equal to or greater than the length of the liquid ejecting head 20 in the case body 12. In other words, the circuit substrate 25 and the power receiving unit 22 are respectively arranged on both sides that interpose a liquid ejectable region (printable region) where the liquid ejecting head 20 can eject liquid in the width direction X in the case body 12 so as to be separate from each other at a distance that is equal to or greater than the length of the liquid ejectable region.

The circuit substrate 25 on which the drive signal generation circuit 58 is mounted and the power receiving unit 22 that includes the non-contact power receiving circuit 57 are arranged on opposite sides to each other with the right and left side frame sections 47B and 47C therebetween. Therefore, a radio wave in the second frequency band, which is generated in the process of generating the drive signal COM by the drive signal generation circuit 58, and a radio wave in the first frequency band, which is generated when the non-contact power receiving circuit 57 transmits power (receives power) in a non-contact manner are blocked by the metal side frame sections 47B and 47C. Therefore, it is possible to more effectively suppress the drive signal COM that is generated at the circuit substrate 25 and is transmitted to the liquid ejecting head 20 from being affected by electric interference due to resonance or the like with the radio wave in the first frequency band which is transmitted between the power sending section 33 of the power sending unit 32 in the power supply device 30 and the power receiving section 23 of the power receiving unit 22. In addition, it is possible to further effectively suppress the radio wave in the first frequency band that is transmitted between the power sending section 33 of the power sending unit 32 and the power receiving section 23 of the power receiving unit 22 in a non-contact manner from being affected by electric interference due to resonance or the like with the radio wave in the second frequency band that is emitted from the circuit substrate 25 and a signal transmission system when the drive signal COM is generated.

As illustrated in FIG. 3, a metal bottom frame section 47D with a plate shape is arranged at a position corresponding to the bottom surface of the first accommodation space SA1 in the case body 12. The circuit substrate 25 assembled with the side frame section 47B is blocked in two directions by the metal frame sections 47B and 47D. However, the circuit substrate 25 is located so as to be separate from the first surface 41 and the fifth surface 45 as outer circumferential surfaces of the case body 12 in non-blocked directions. In contrast, the power receiving unit 22 is arranged at a position closer to the fifth surface 45 as an outer circumferential surface of the case body 12 in a direction (lower side in FIG. 3) in which the power transmission is performed from among directions other than the direction blocked by the side frame section 47C. That is, the circuit substrate 25 is arranged such that surfaces (the right surface and the upper surface in FIG. 3) that are not blocked by the frame sections 47B and 47D are arranged at further positions from the outer circumferential surface (fifth surface 45) of the case body 12 toward the inner side as compared with the surface on the side of the power receiving section 23 of the power receiving unit 22.

Here, it is only necessary to block the entire circumferences of the power receiving unit 22 (or the non-contact power receiving circuit 57) and the circuit substrate 25 with metal boxes, or the like, as a countermeasure for avoiding interference between the drive signal and the radio wave in the first frequency band for power transmission and avoiding interference between the radio wave for the power transmission and the radio wave in the second frequency band that is generated when the drive signal is generated. However, if the power receiving unit 22 is completely blocked, smooth power supply from the power supply device 30 to the printer 11 is inhibited. If the power receiving unit 22 is arranged so as to be separate from the outer circumferential surface of the case body 12 toward the inner side, it becomes difficult to receive power from the power supply device 30. Therefore, at least the surface, which includes the power receiving section 23, of the power receiving unit 22 is opened without being blocked by the metal frame section and is arranged at a close position to the outer circumferential surface of the case body 12 to facilitate the reception of the radio wave in the first frequency band. In contrast, the circuit substrate 25 is arranged at a further position from the outer circumferential surface of the case body 12 toward the inner side to reduce the influence of the radio wave from the outside of the case body 12.

The printer 11 may be a serial printer provided with a liquid ejecting head in a carriage that can move in the main scanning direction instead of the line printer in which the liquid ejecting head 20 is a line head. In the case of the serial printer, the circuit substrate 25 including the drive signal generation circuit 58 and the power receiving unit 22 may be disposed in the first accommodation space SA1 and the second accommodation space SA2 on both sides that interposes the liquid ejectable region where the carriage can move and eject liquid in the width direction in the case body so as to satisfy the aforementioned conditions.

As illustrated in FIGS. 2 and 3, the power receiving unit 22 includes the power receiving section 23 and the communication section 24 that are exposed from one surface of a main body 22A thereof. Then, the power receiving unit 22 is disposed in a state where the power receiving section 23 and the communication section 24 are exposed from through holes in the bottom plate of the case body 12 toward the outside (on the side of the bottom surface). As illustrated in FIG. 2, a so-called multi-head-type liquid ejecting head in which a plurality of unit heads are aligned in a predetermined arrangement pattern is employed as the liquid ejecting head 20. In the example in FIG. 2, the plurality of unit heads 26 are arranged in two arrays at a constant pitch in the width direction X and are arranged in an arrangement pattern in which the arrays deviate from each other at a half pitch. The liquid ejecting head 20 may be configured to include a single long unit head.

Figure 4:
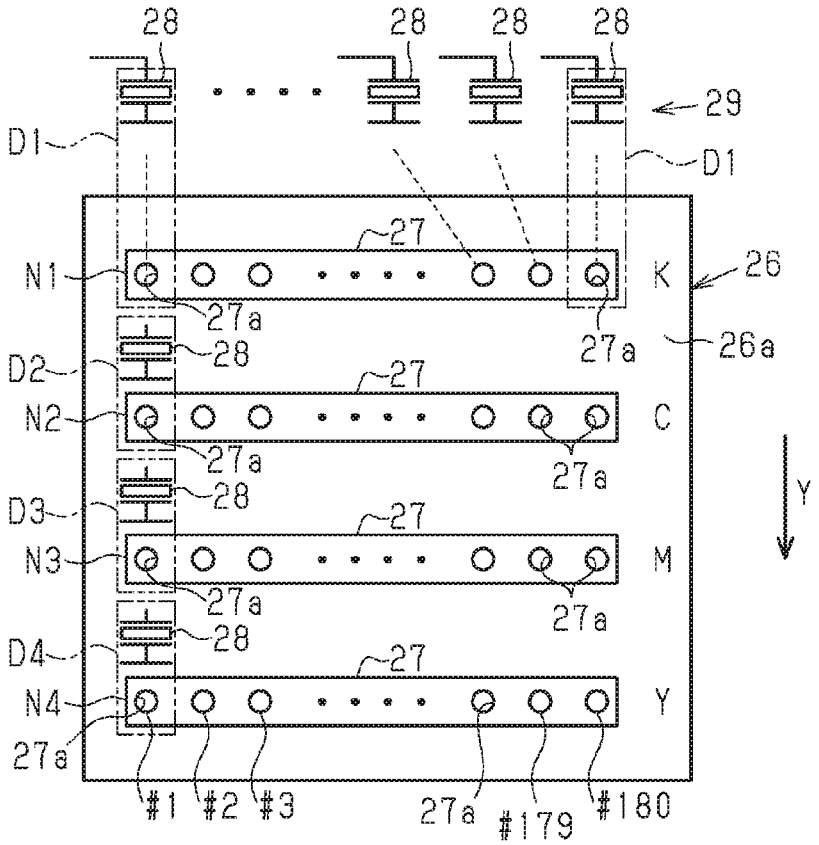
FIG. 4 is a bottom view schematically illustrating a unit head and a part of an ejection drive system.

As illustrated in FIG. 4, n head array sections 27 provided in a nozzle opening surface 26*a* (bottom surface) of each unit head 26 includes one of n (four in FIG. 4) nozzle arrays N1 to Nn. Each of the nozzle arrays N1 to Nn is formed of F (F=180 in the example of FIG. 4) nozzles #1 to #F aligned in one array at a constant nozzle pitch in a direction (nozzle array direction) that intersects the transport direction Y of the media P. The alignment of the nozzles #1 to #F forming the nozzle arrays is not limited to one-array alignment and may be a zigzag alignment in which two arrays deviate from each other at a half pitch.

In this example, the n nozzle arrays N1 to Nn eject ink droplets of different colors or ink droplets of the same color. In the former case, the n nozzle arrays N1 to Nn eject ink droplets with different colors. In a case where n=4 as in the example in FIG. 4, the four nozzle arrays N1 to N4 eject ink droplets of four colors, black (K), cyan (C), magenta (M), and yellow (Y) from the respective nozzles 27*a*.

As illustrated in FIG. 4, ejection drive elements 28 corresponding to the respective nozzles 27*a* are built in each head array section 27 such that the number of the ejection drive elements 28 is the same as that of the nozzles in each nozzle array. The plurality of ejection drive elements 28 of each nozzle array forms an ejection drive element group 29. However, FIG. 4 schematically illustrates a part of the ejection drive elements 28 corresponding to the nozzles 27*a* outside the unit head 26. The ejection drive elements 28 are formed of piezoelectric oscillators or electrostatic drive elements, for example, and oscillate an oscillation plate 175 (see FIG. 5) that forms a part of an inner wall section of an ink chamber (a cavity 174 in FIG. 5) communicating with the nozzles 27*a* as will be described later by an electrostriction effect or an electrostatic drive effect in response to an application of the drive signal COM (see FIG. 8) with a predetermined waveform. Ink droplets are ejected from the nozzles 27*a* by causing the ink chamber to expand and contract by the oscillation of the oscillation plate 175.

As illustrated in FIG. 4, each of the head array sections 27 corresponding to the nozzle arrays N1 to Nn includes a plurality of (F) ejecting sections D1 to Dn including the nozzles 27*a* and the ejection drive elements 28. In this case where n=4, each of the head array sections 27 corresponding to the nozzle arrays N1 to N4 includes 180 ejecting sections D1, 180 ejecting sections D2, 180 ejecting sections D3, or 180 ejecting sections D4 that include the nozzles 27*a* and the ejection drive elements 28. The ejecting sections D1 to D4 will be simply referred to as "ejecting sections D" in a case where the ejecting sections D1 to D4 are not particularly distinguished from each other. In the embodiment, the ejecting sections D that eject liquid in response to a drive signal forms an example of the liquid ejecting section.

Figure 5:
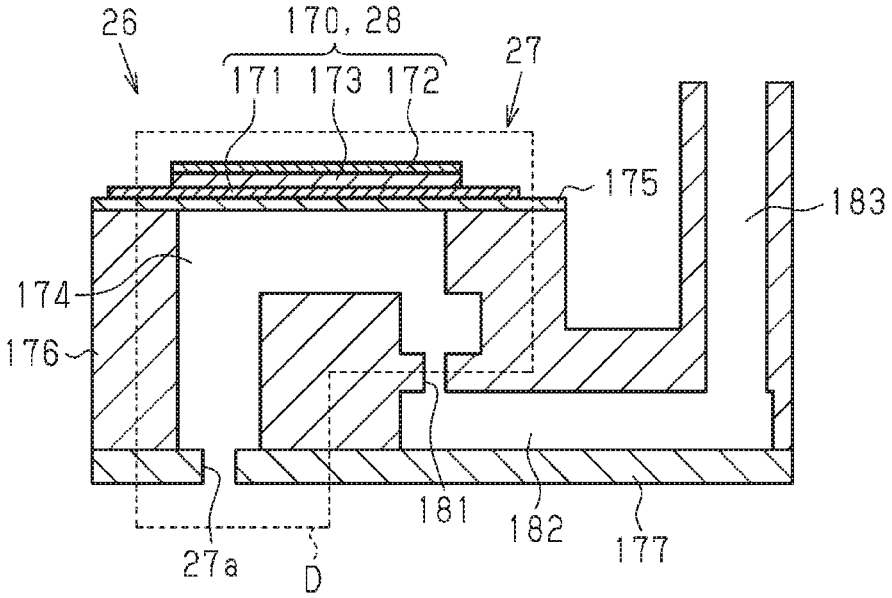
FIG. 5 is a sectional view schematically illustrating a liquid ejecting section in the unit head.

Next, description will be given of a configuration of the ejecting sections D that eject ink droplets from the nozzles 27*a* in the unit heads 26 with reference to FIG. 5. FIG. 5 illustrates one ejecting section D from among the same number of ejecting section D as the number of the plurality of nozzles 27*a* provided in each unit head 26, a reservoir 182 that communicates the one ejecting section D through an ink supply port 181, and an ink supply flow path 183 for supplying ink from an ink supply source (not shown) such as an ink cartridge or an ink tank to the reservoir 182.

As illustrated in FIG. 5, each ejecting section D includes a piezoelectric element 170 as an example of the ejection drive element 28, a cavity 174 (ink chamber) filled with ink, a nozzle 27*a* that communicates with the cavity 174, and an oscillation plate 175. In the ejecting section D, the piezoelectric element 170 is driven by an application of a drive voltage based on the drive signal, and the ink in the cavity 174 is ejected from the nozzle 27*a*.

The cavity 174 of the ejecting section D is a space sectioned by a cavity plate 176 formed into a predetermined shape with a recessed section, a nozzle plate 177 with the nozzle 27*a* formed therein, and the oscillation plate 175. The cavity 174 communicates with the reservoir 182 through the ink supply port 181. The reservoir 182 communicates with one ink supply source (not shown) through the ink supply flow path 183.

In the embodiment, a unimorph (monomorph)-type piezoelectric element as illustrated in FIG. 5, for example, is employed as the piezoelectric element 170. The piezoelectric element 170 includes a lower electrode 171, an upper electrode 172, and a piezoelectric body 173 between the lower electrode 171 and the upper electrode 172. The lower electrode 171 is set to have a predetermined reference potential Vs, and a voltage is applied between the lower electrode 171 and the upper electrode 172 by supplying the drive signal to the upper electrode 172. The piezoelectric element 170 is bent and vibrates in the vertical direction in FIG. 5 in accordance with the voltage applied.

The lower electrode 171 of the piezoelectric element 170 is joined to the oscillation plate 175 installed in a state of blocking an upper surface opening of the cavity plate 176. Therefore, the oscillation plate 175 also oscillates if the piezoelectric element 170 oscillates in response to the drive signal. Then, the volume of the cavity 174 (a pressure in the cavity 174) varies due to the oscillation of the oscillation plate 175, and the ink in the cavity 174 is ejected from the nozzle 27*a*.

In a case where the amount of the ink in the cavity 174 decreases due to the ejection of the ink, the ink is supplied from the reservoir 182 to the cavity 174. In addition, the ink is supplied from the ink supply source to the reservoir 182 through the ink supply flow path 183.

Next, description will be given of an electrical configuration of a rechargeable liquid ejecting system with reference to FIG. 6.

Here, a control device (circuit) that controls the printer 11 is formed of a plurality of circuit sections mounted on the circuit substrate 25 (main substrate) (FIG. 1).

The printer 11 includes a controller 50 (control device), a head substrate 51 that is built in the liquid ejecting head 20, the feeding motor 17 as a drive source of the feeding device that feeds the media, the transport motor 18 as a drive source of the transport device that transports the media, and the battery 19. One head substrate 51 may be commonly provided for a plurality of unit heads 26, for example, or may be provided for each unit head 26.

The controller 50 includes an interface circuit 52, a control circuit 53, a head control circuit 54, motor drive circuits 55 and 56, and a non-contact power receiving circuit 57. The interface circuit 52 organize print data input from a host device 100 into data that can be processed by the control circuit 53 and transmits the data to the control circuit 53. The host device 100 may be formed of a personal computer (hereinafter, also referred to as a "PC"), for example. The host device 100 is not limited to the PC and may be a smart device such as a Personal Digital Assistant (PDA), a tablet PC, or a smart phone.

The control circuit 53 is formed of a computer and includes a Central Processing Unit (CPU) 61 and a Read-Only Memory (ROM) 62 and a Random Access Memory (RAM) 63 as storage sections in a built-in manner. The ROM 62 stores various control programs for controlling operations of the printer 11, accompanying data, and the like. The accompanying data includes a data table of drive signal data for driving the piezoelectric element 170 (FIG. 5) of the liquid ejecting head 20. The table stores a plurality of drive signal data items in accordance with resolutions (dot sizes), gradations, color tones, and the like.

The RAM 63 temporarily stores input print data, processing data necessary for printing the print data, and the like. In addition, the program for printing processing or the like is temporarily developed in some cases. The invention is not limited to this configuration, and a one-chip dedicated system Integrated Circuit (IC) such as a micro controller unit (MCU) including a ROM and a RAM may be used.

Furthermore, the control circuit 53 divides (generates) the print data input via the interface circuit 52 into two data items, namely print data and drive signal data and transmits the data items to the head control circuit 54. The head control circuit 54 includes the drive signal generation circuit 58 that generates a drive signal based on the input drive signal data. The head control circuit 54 transmits the print data and the drive signal COM (see FIG. 8) to the head substrate 51 via a flexible wiring substrate 59 (hereinafter, also referred to as an "FPC 59"). The print data is information about ON/OFF switching of the piezoelectric elements 170 (FIG. 5) in the unit heads 26 forming the liquid ejecting head 20 and control of ejection timing. The drive signal data SD is information about a voltage (drive signal) to be applied to the piezoelectric elements 170 (FIG. 5) in the unit heads 26. Although FIG. 6 illustrates one head control circuit 54 for driving one unit head 26 (FIG. 4) for simplicity, head control circuits 54 corresponding to the number of unit heads 26 (head substrates 51) are mounted on the circuit substrate 25 (see FIGS. 1 to 3) in practice. A detailed circuit configuration of the drive signal generation circuit 58 will be described later.

The motor drive circuit 55 is a drive circuit for the feeding motor 17 that rotates the feeding roller and drives the feeding motor 17 based on a control signal from the control circuit 53. The motor drive circuit 56 is a drive circuit for the transport motor that rotates the transport roller and drives the transport motor 18 based on a control signal from the control circuit 53.

Figure 6:
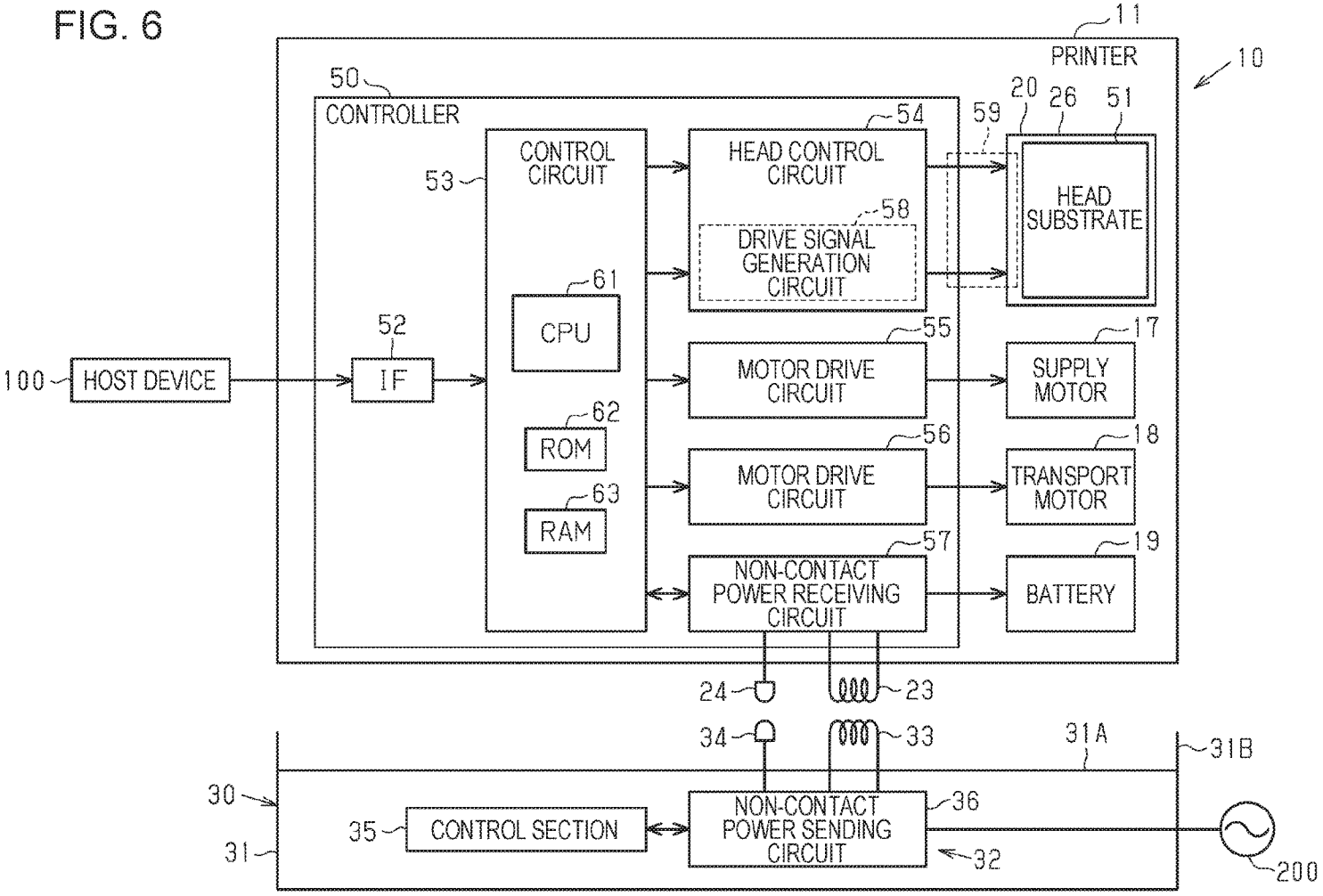
FIG. 6 is a block diagram illustrating an electrical configuration of the liquid ejecting system.

As illustrated in FIG. 6, the power sending unit 32 provided in the power supply device 30 includes a control section 35 and a non-contact power sending circuit 36. The non-contact power sending circuit 36 generates a pulse voltage at a predetermined frequency based on DC power obtained by AC/DC converting AC current input from the commercial AC power source 200, for example. The non-contact power sending circuit 36 supplies the power from the power sending section 33 to the power receiving section 23 in a non-contact manner by causing the pulse current at the predetermined frequency to flow to the power sending section 33. The non-contact power sending circuit 36 includes a communication section 34 that performs near-field wireless communication with the communication section 24 on the side of the printer 11. In the state where the printer 11 is installed on the installation surface 31A of the pad 31 of the power supply device 30, the power sending section 33 and the power receiving section 23 face each other in a non-contact manner, and the communication sections 24 and 34 are arranged so as to face each other in a non-contact manner.

The non-contact power receiving circuit 57 illustrated in FIG. 6 is built in the power receiving unit 22. The control circuit 53 provides instructions for starting and stopping power supply (power sending) by the non-contact power sending circuit 36 to the control section on the side of the power sending unit 32 via wireless communication between the communication sections 24 and 34. In a case where driving timing of the drive signal generation circuit 58 overlaps with that of the non-contact power receiving circuit 57, the control circuit 53 performs exclusive control so as to drive one of the drive signal generation circuit 58 and the non-contact power receiving circuit 57 with priority and restrict drive of the other. When it is necessary to receive power by the non-contact power receiving circuit 57, the control circuit 53 provides a request for starting the power supply to the non-contact power sending circuit 36 in the power sending unit 32 provided in the power supply device 30 via the communication sections 24 and 34. If it is not necessary to receive power, the control circuit 53 provides a request for stopping the power supply. The control section 35 receives the request for starting the power supply from the control circuit 53 via the communication sections 24 and 34, then drives the non-contact power sending circuit 36, and causes the power sending section 33 (power sending coil) to supply the pulse current at the predetermined frequency. If the pulse current at the predetermined frequency flows through the power sending section 33 (power sending coil), then a pulse current at the same predetermined frequency flows through the power receiving section 23. In doing so, the power receiving section 23 receives the power supply from the power sending section 33. The control section 35 receives the request for stopping the power supply from the control circuit 53 via the communication sections 24 and 34, stops the driving of the non-contact power sending circuit 36, and stops the supply of the pulse current at the predetermined frequency to the power sending section 33 (power sending coil). As a result, the supply of the pulse current at the predetermined frequency by the power sending section 33 is stopped, and the power supply from the power sending section to the power receiving section 23 is stopped. In the embodiment, the non-contact power receiving circuit 57 corresponds to one example of the non-contact power transmission circuit, and power reception is performed as an example of the power transmission.

Figure 7:
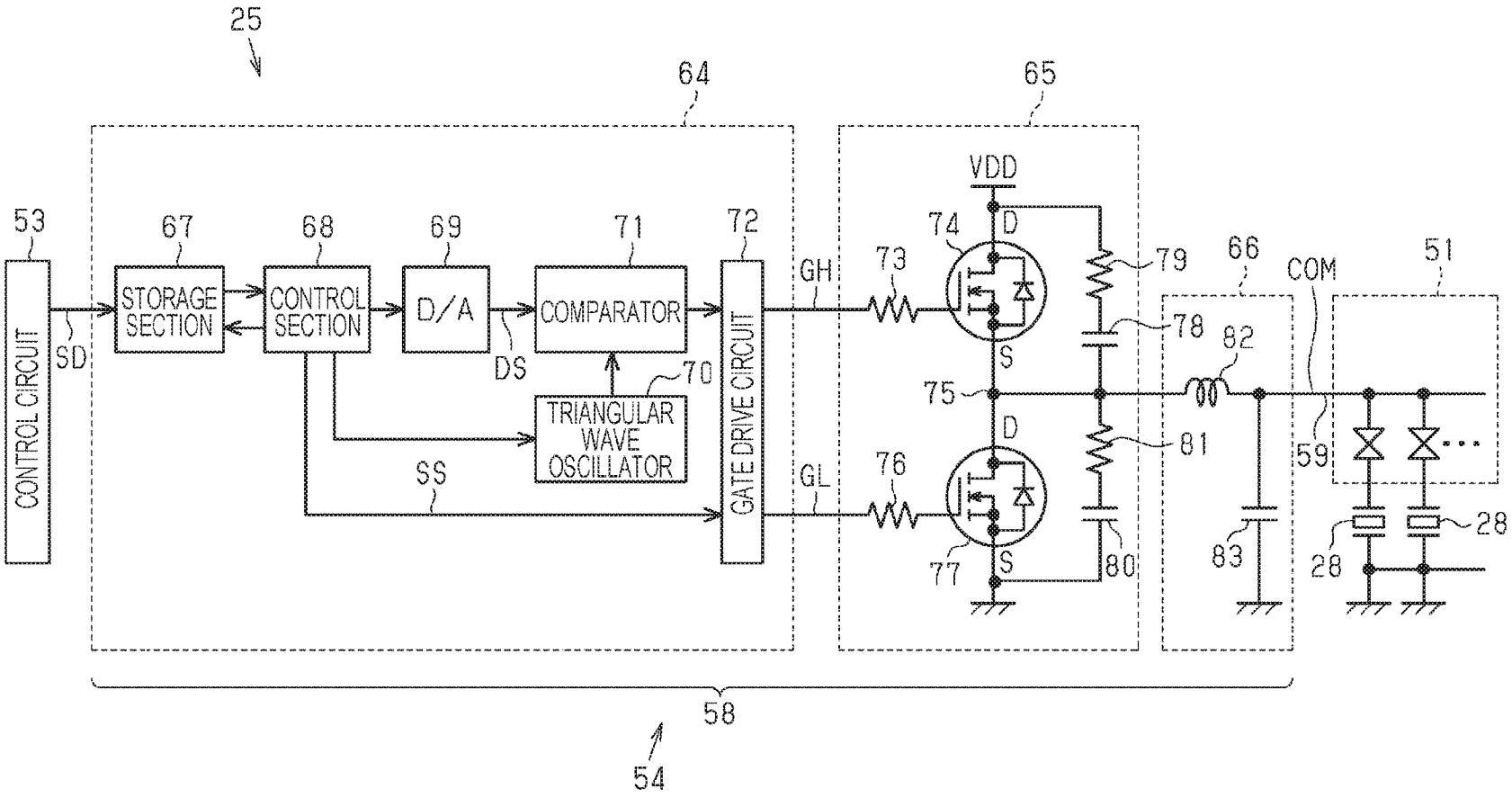
FIG. 7 is a circuit diagram illustrating an electrical configuration of a drive signal generation circuit.

Next, detailed description will be given of a configuration of the drive signal generation circuit 58 provided in the head control circuit with reference to FIG. 7.

The drive signal generation circuit 58 is a so-called class-D amplifier (digital amplifier) formed of a drive IC 64, a switching circuit 65, a filter circuit 66, and the like.

The drive IC 64 D/A converts the drive signal data SD in a digital format supplied from the control circuit 53 and generates an original drive signal DS. Furthermore, the drive IC 64 performs pulse density modulation on the original drive signal DS and switches the switching circuit 65 based on the generated modulation data. The drive IC 64 includes a storage section 67, a control section 68, a D/A conversion section 69, a triangular wave oscillator 70, a comparator 71, a gate drive circuit 72, and the like.

The storage section 67 is a RAM and stores the drive signal data SD formed of digital potential data and the like.

The control section 68 converts the drive signal data read from the storage section 67 into a voltage signal, holds the voltage signal corresponding to a predetermined sampling cycle, and provides instructions about a frequency of a triangular wave signal, a drive signal, a drive signal output timing, and the like to the triangular wave oscillator 70 which will be described later. In addition, the control section 68 also outputs an operation stop signal SS (during operation: high level) for stopping operations of the gate drive circuit 72.

The D/A conversion section 69 analog converts the voltage signal output from the control section 68 and outputs the original drive signal DS. That is, the storage section 67, the control section 68, and the D/A conversion section 69 function as an original drive signal generation circuit.

The triangular wave oscillator 70 outputs a triangular wave signal as a reference signal in accordance with the frequency, the drive signal, and the drive signal output timing based on the instructions from the control section 68.

The comparator 71 compares the original drive signal DS output from the D/A conversion section 69 with the triangular wave signal output from the triangular wave oscillator 70 and outputs a modulation signal (high frequency) of pulse duty that becomes on duty when the original drive signal DS is greater than the triangular wave signal. As described above, the triangular wave oscillator and the comparator 71 function as a modulation circuit (A/D converter).

The gate drive circuit 72 selectively turns on any of two transistors 74 and 77 of the switching circuit 65, which will be described later, based on the modulation signal from the comparator 71. In other words, the gate drive circuit 72 alternately switches (ON/OFF) the transistors 74 and 77 for switching. In a case where the operation stop signal SS from the control section 68 is in a low level, both the two transistors 74 and 77 are turned off.

The switching circuit 65 is formed of the two transistors 74 and 77, a capacitor 78, a resistance 79, a capacitor 80, a resistance 81, and the like. The gate drive circuit 72 and the switching circuit 65 function as a digital power amplifier circuit.

The transistor 74 is a Metal Oxide Semiconductor Field Effect Transistor (MOSFET), a gate terminal is connected to an output terminal GH on a high side of the gate drive circuit 72, a source terminal is connected to an intermediate node 75 (also referred to as an intermediate potential 75) as a half bridge output stage, and a drain terminal is connected to a VDD. In a preferred example, a resistance 73 is inserted (interposed) between the output terminal GH and the gate terminal.

The transistor 77 is a MOSFET, a gate terminal is connected to an output terminal GL on a low side of the gate drive circuit 72, a source terminal is connected to GND, and a drain terminal is connected to the intermediate node 75. In a preferred example, a resistance 76 is inserted (interposed) between the output terminal GL and the gate terminal. The resistances 73 and 76 are overcurrent preventing resistances for preventing overcurrent to the gate terminals.

In a preferred example, the capacitor 78 and the resistance 79 are connected in series in this order between the source terminal and the drain terminal of the transistor 74. Similarly, the capacitor 80 and the resistance 81 are connected in series in this order between the source terminal and the drain terminal of the transistor 77. These capacitor resistances are circuits for reducing high-frequency noise at the time of the switching. The invention is not limited to this configuration, and a configuration including only two transistors 74 and 77 is also applicable.

The output signal of the switching circuit 65 is output from the intermediate node 75 to the filter circuit 66. The output signal is an amplified modulation signal obtained by amplifying the modulation signal and is a high-frequency pulse signal of continuous pulses (rectangular waves) with VDD potentials (wave heights) with reference to the GND.

The filter circuit 66 is a low-pass filter that is formed of a coil 82, a capacitor 83, and the like.

The coil 82 has one end connected to the intermediate node 75 and the other end connected to one end of the capacitor 80. The other end of the capacitor 80 is connected to the GND. In addition, the other end of the coil 82 is an output line of the drive signal COM. Specifically, a high-frequency area of the amplified modulation signal input from the switching circuit 65 to the filter circuit 66 is cut, the amplified modulation signal is demodulated into an analog signal corresponding to the amplified original drive signal DS, becomes the drive signal COM, and is then supplied to the head substrate 51 via the FPC 59.

Next, description will be given of an example of a drive signal and print data with reference to FIG. 8.

Here, description will be given of a drive signal (waveform) generated by the drive signal generation circuit 58 in the head control circuit 54. A representative drive signal COM has such a waveform that rises from an intermediate potential Vo of the intermediate node 75, is maintained at a high potential (VDD) for a while, falls below the intermediate potential Vo, is maintained at a low potential (GND) for a while, then rises to the intermediate potential Vo again, and is maintained at the intermediate potential Vo for a while as a waveform PCOM2. In addition, a waveform that rises from the intermediate potential Vo, is maintained at a high potential for a while, falls to the intermediate potential Vo, and is maintained at the intermediate potential Vo for a while as a waveform PCOM1 is also a drive waveform. That is, the drive signal COM is formed of unit waveforms PCOM1, PCOM2, PCOM3, . . . that continue in a time-series manner.

The head control circuit 54 generates the drive signal COM by the drive signal generation circuit 58 and also generates a latch signal LAT and a channel signal CH. The latch signal LAT is a pulse signal that defines a start timing of a printing cycle that is a cycle at which an ink droplet corresponding to one dot (one pixel) is ejected. The channel signal CH is a pulse signal that defines switching timing of the plurality of unit waveforms PCOM1, PCOM2, PCOM3, and PCOM4 in the printing cycle. The head control circuit 54 outputs the drive signal COM to the unit heads in a synchronized manner with the latch signal LAT and the channel signal CH and outputs print data SI and SP to the unit heads 26.

In the case of the waveform PCOM2, the rising part corresponds to a stage where the volume of the cavity 174 (FIG. 5) communicating with the nozzle 27*a* (FIG. 5) is made to expand to draw the ink (draw meniscus in consideration of an ink ejecting surface), and the falling part corresponds to a stage where the volume of the cavity 174 is made to contract to push the ink (push the meniscus). With such operations, the ink droplets are ejected from the nozzle 27*a*. The waveform PCOM1 is a unit waveform called minute oscillation and is a waveform to stir the ink and suppress an increase in viscosity by oscillating the ink in the vicinity of the nozzle 27*a* in a level in which the ink is not ejected (the meniscus is made to move into or out of the nozzle 27*a*).

The ink droplets may be ejected only with a single waveform PCOM2. It is possible to change a drawing amount, a drawing speed, a pushing amount, and a pushing speed of the ink and to obtain ink droplets with different sizes by variously changing inclination of an increase and a decrease in the voltage with the waveform PCOM2 formed of a trapezoidal wave and a wave height value.

Figure 8:
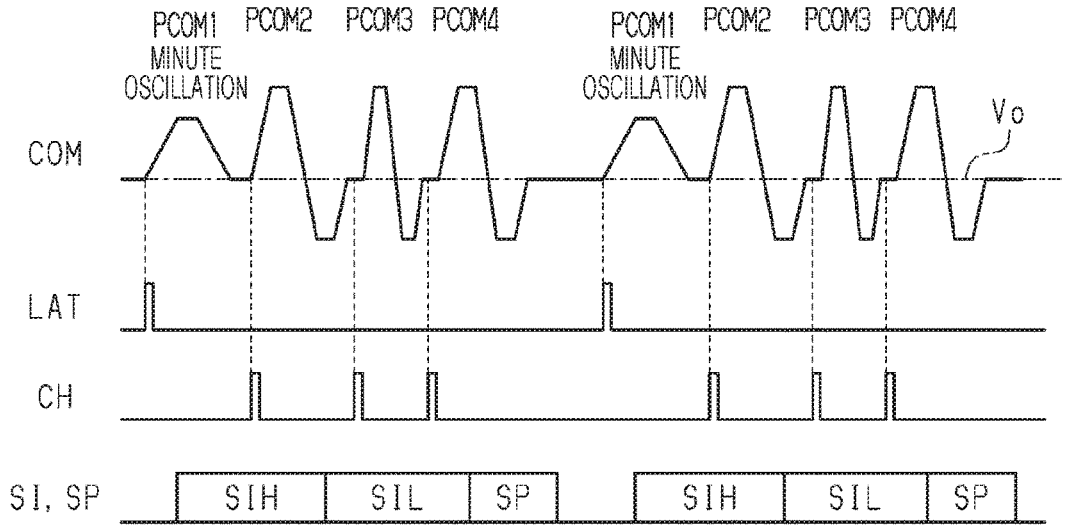
FIG. 8 is a timing chart illustrating a drive signal and print data.

It is possible to cause the next ink droplet to land at the same position before the previously landing ink does not dry by coupling a plurality of drive waveforms in a time-series manner as the drive signal COM illustrated in FIG. 8, and to thereby increasing the size of a printed dot. A combination of such technologies enables multiple gradations.

As illustrated in FIG. 8, the print data SI and SP are formed of ejection data SI and definition data SP for waveform selection. The ejection data SI is formed of higher-order bit data SIH obtained by collecting only higher-order bit H so as to correspond to 180 nozzles in dot data (HL) represented by 2 bits per pixel (dot) and lower-order bit data SIL obtained by collecting only lower-order bit L so as to correspond to 180 nozzles. The definition data SP is data of a predetermined bit number (4 bits, for example) representing correspondence between 2-bit dot data (HL) in the ejection data SI and one waveform selected from the unit waveforms PCOM1, PCOM2, PCOM3, and PCOM4 in the drive signal COM. The dot data (HL) of the ejection data SI represents four gradations, namely non-ejection, a small dot, an intermediate dot, and a large dot. The dot data of the ejection data SI may represents two gradations, namely non-ejection and ejection (dot).

Next, description will be given of waveform quality of the drive signal COM and the like with reference to FIG. 7.

As described above, the drive signal COM is a signal obtained by amplifying the original drive signal DS generated by the D/A conversion section 69. Specifically, the drive signal COM is a signal obtained by amplifying the original drive signal DS with an amplification width (peak to peak) of several volt (about 3 V, for example) to have an amplification width of several tens of volt (about 42 V, for example). The waveform PCOM2, for example, is a waveform obtained by amplifying the waveform of the original drive signal DS.

Here, as waveform quality (similarity before and after the amplification) of the drive signal COM, the waveform of the original drive signal DS is substantially faithfully reproduced while jaggy is suppressed.

This is because the pulse density modulation scheme is employed. Specifically, when the voltage of the power source is 42 V, for example, the amplification width of the drive signal COM requires a wide range from about 2 to 37 V. In order to perform pulse modulation while securing the waveform quality, it is necessary to perform the drive with a modulation signal at a high frequency of megahertz order. According to experiment results, the pulse density modulation scheme is more suitable for the high-frequency drive than a pulse width modulation scheme at a constant cycle. Typical audio devices use frequencies from about 32 kHz to 400 kHz. In addition, the invention is not limited to the pulse density modulation scheme, and any modulation scheme may be employed as long as the scheme can handle the high-frequency drive of megahertz order.

Figure 9:
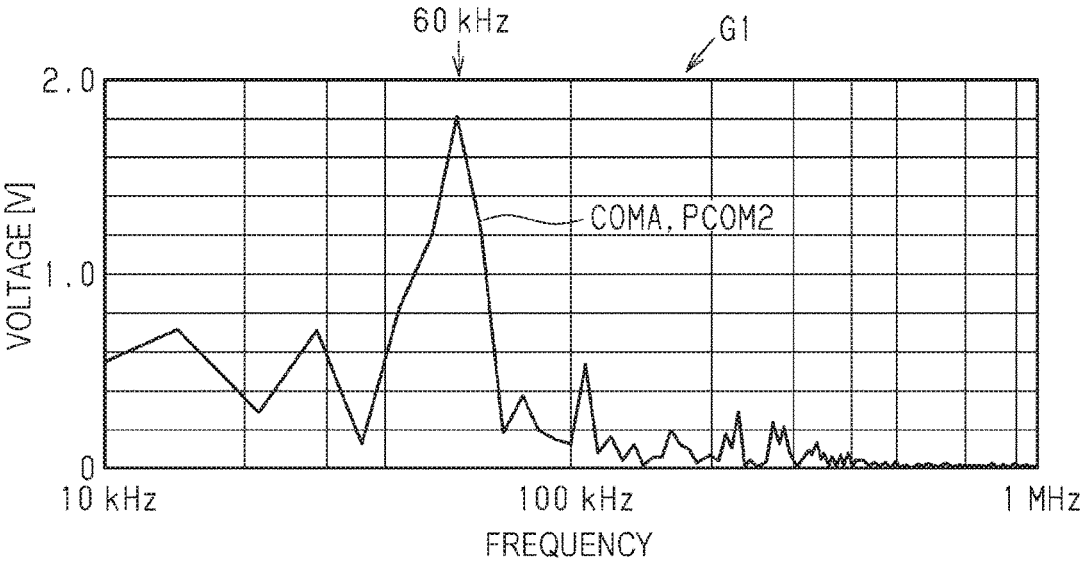
FIG. 9 is a spectral analysis diagram of an original drive signal.

Next, description will be given of spectral analysis of the original drive signal DS with reference to FIG. 9. Specifically, FIG. 9 is a diagram illustrating frequency spectral analysis of the waveform COMA (the waveform PCOM2 after the amplification) of the original drive signal DS in FIG. 8. As illustrated in Graph G1, it is possible to recognize that the waveform COMA of the original drive signal DS obtained by the frequency spectral analysis includes a frequency from about 10 kHz to 400 kHz.

In order to amplify the drive signal with a digital amplifier, it is necessary to drive the digital amplifier at a switching frequency of at least 10 or more times as high as a frequency component included in the drive signal before the amplification. If the switching frequency of the digital amplifier is less than 10 times as high as the frequency spectrum included in the drive signal, it is not possible to modulate and amplify a high-frequency spectrum component included in the drive signal, and an edge of the drive signal becomes unsharpened and rounded. If the drive signal becomes unsharpened, there is a possibility that the piezoelectric element that operates in accordance with a rising edge and falling edge of the waveform moves more slowly, the amount of ejection becomes unstable, or the ink is not ejected. That is, there is a concern that the drive becomes unstable.

Since the peak is reached at about 60 kHz as illustrated by Graph G1 in FIG. 9 and the most components are less than 100 kHz in the embodiment, it is preferable to use a digital amplifier that can be driven at a switching frequency of at least about 1 MHz that is 10 times as high as 100 kHz.

Here, the frequency component included in the original drive signal differs depending on the size of the ink droplets to be ejected and a waveform of the original drive signal in accordance with the size of the liquid ejecting head 20 (or unit heads 26). The amplification width of the waveform COMA is as small as about 2 V as illustrated in FIG. 9 since the waveform COMA is a waveform of the original drive signal for ejecting ink droplets with a smaller size than a standard size. In order to eject ink droplets with a smaller size, it is necessary to steeply move the piezoelectric element 170 and to eject a small amount of ink droplets. Therefore, it is necessary for the drive signal to include many high-frequency spectrum components. Also, it is necessary to quickly move the piezoelectric element 170 for high-speed printing and to thereby include many high-frequency components. That is, a required minimum frequency increases as high-speed high-quality printing is pursued.

The drive signal COM according to the embodiment is designed for ordinary domestic use and use in offices, and is designed on the assumption that printing of about 5760× 1440 dpi is performed on five A4 sheets per minute by using 180 piezoelectric elements.

A different problem also occurs in a case where a switching frequency is high. If it is attempted to perform switching at a high voltage and a high frequency to drive the piezoelectric element 170, many problems such as an increase in junction capacitance, occurrence of noise due to the increase in junction capacitance, and an increase in switching loss due to the high-frequency drive are caused a structure of a switching transistor. In particular, the increase in switching loss can be a severe problem in the digital amplifier. That is, there is a concern that the increase in switching loss may damage advantages such as a power saving property and low heat generation due to which the digital amplifier secures superiority over class-AB amplifiers (analog amplifiers).

According to the embodiment, a result indicating that the digital amplifier has superiority over the analog amplifiers (class-AB amplifier) used in the related art up to 8 MHz is obtained. However, it is known that the class-AB amplifiers can have superiority in a case where the transistor is driven at a frequency that is equal to or greater than 8 MHz.

In view of the above circumstances, the frequency of the modulation signal is more preferably equal to or greater than 1 MHz and less than 8 MHz. According to the embodiment, the frequency of the modulation signal may be set within the range of equal to or greater than 1 MHz and less than 8 MHz in accordance with a specification or ejection quality of the ejecting sections D (piezoelectric elements 170).

Next, description will be given of an electrical configuration of the unit head 26 with reference to FIG. 10. The head control circuit 54 illustrated in FIG. 10 transfers the print data SI and SP received from the control circuit 53, the drive signal COM generated by the drive signal generation circuit 58, and the latch signal LAT and the channel signal CH to the head drive circuit 90 mounted on the head substrate 51 in each unit head 26 via the FPC 59.

Figure 10:
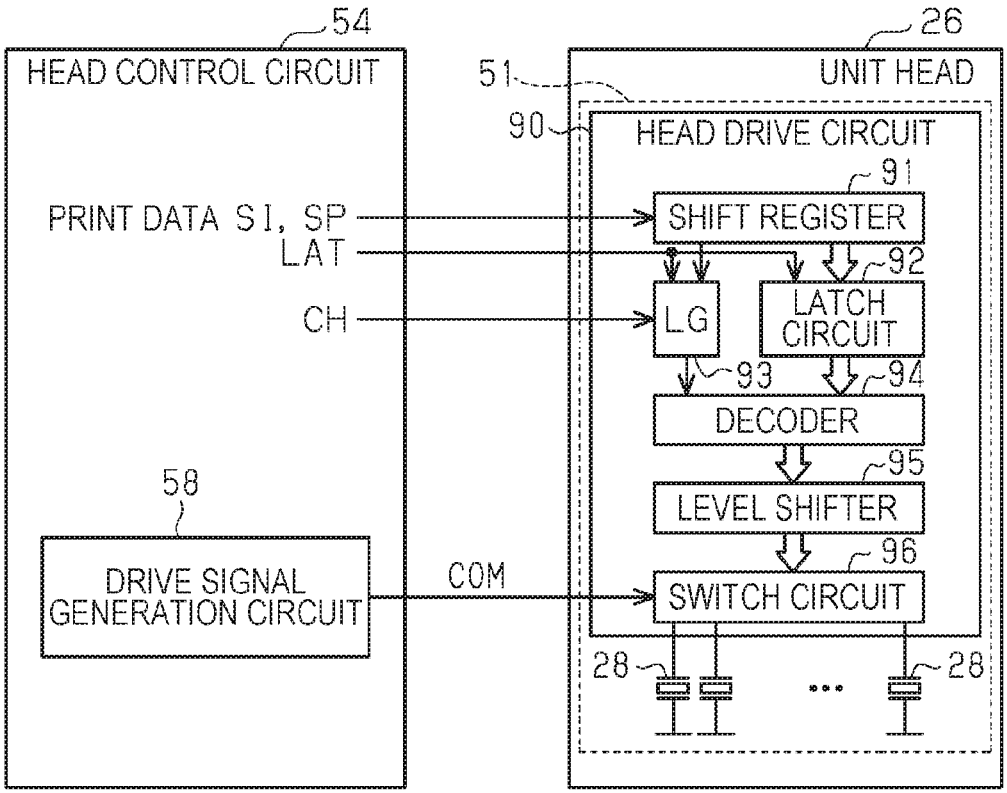
FIG. 10 is a block diagram illustrating an electrical configuration of a head drive circuit.

As illustrated in FIG. 10, the head drive circuit includes a shift register 91, a latch circuit 92, a control logic 93, a decoder 94, a level shifter 95, and a switch circuit 96.

The head control circuit 54 transfers the print data SI and SP corresponding to each nozzle array to the head drive circuit 90, and the transferred print data SI and SP for each nozzle array is sequentially input to the shift register 91. The latch signal LAT from the drive signal generation circuit 58 is input to the latch circuit 92, and the channel signal CH is input to the control logic 93. The drive signal COM from the drive signal generation circuit 58 is input to the switch circuit 96.

The print data SI and SP for 180 nozzles (180 bits), for example, corresponding to one nozzle array is input to the shift register 91. The shift register 91 includes a first shift register (first SR), a second shift register (second SR), and a third shift register (third SR) which are not shown in the drawing. Higher-order bit data SIH in the ejection data SI is stored in the first SR, and lower-order bit data SIL is stored in the second SR. The definition data SP is stored in the third SR.

The latch circuit 92 holds the ejection data SI (SIH, SIL) from the shift register 91 (first SR and second SR) based on the LAT signal and outputs the ejection data SI held until then to the decoder 94 at timing of a printing cycle.

The control logic 93 stores a table for interpretation rules. In 2-bit gradation information (HL) of the ejection data SI, non-ejection (minute oscillation) is represented as "00", a small dot is represented as "01", an intermediate dot is represented as "10", and a large dot is represented as "11". The definition data SP defines correspondence between such 2-bit gradation information (HL) and the unit waveforms PCOM1, PCOM2, PCOM3, and PCOM4. Pulse selection information in accordance with the ejection data SI (gradation information HL) is output from the decoder 94 by interpretation processing in accordance with the interpretation rules via the control logic 93 and the decoder 94 based on the definition data SP.

The decoder 94 has an interpretation function, interprets the gradation information as each combination of the higher-order bit data SIH and the lower-order bit data SIL corresponding to the 180 nozzles (one nozzle array) forming the ejection data SI based on the interpretation rule information from the control logic 93, and outputs pulse selection information of a plurality of bits (4 bits in this example) corresponding to the 180 nozzles.

When the input ejection data SI is "00", for example, the decoder 94 outputs waveform selection information (0010) indicating selection of the third waveform PCOM3. When the ejection data SI is "01", the decoder 94 outputs waveform selection information (0100) indicating selection of the second waveform PCOM2. Furthermore, when the input ejection data SI is "10", the decoder 94 outputs waveform selection information (0001) indicating selection of the fourth waveform PCOM4. When the input ejection data SI is "11", the decoder 94 outputs waveform selection information (1000) indicating selection of the first waveform PCOM1 to the switch circuit 96. The four-digit waveform selection information is input to the switch circuit 96 via the level shifter 95 in a descending order from the higher-order bit to the lower-order bit. The four-digit waveform selection information corresponds to each of the first to fourth waveforms PCOM1, PCOM2, PCOM3, and PCOM4, and the switch circuit 96 selects a waveform corresponding to a digit where the value is "1".

The level shifter 95 functions as a voltage amplifier, and in a case where a bit value is "1", the level shifter 95 outputs an electrical signal with a voltage boosted to about several tens of volt, for example, with which the switch circuit 96 can be driven. The drive signal COM is supplied from the drive signal generation circuit 58 to the input side of the switch circuit 96, and the ejection drive elements 28 (piezoelectric elements 170) are connected to the output side of the switch circuit 96.

The switch circuit 96 selects a waveform in accordance with the ejection data SI (HL) from among the first to fourth waveforms PCOM1, PCOM2, PCOM3, and PCOM4 by switching ON/OFF states based on the input drive signal COM and the waveform selection information input from the decoder 94 via the level shifter 95, and applies the waveform to the ejection drive element 28. The ejection drive element 28 is driven in an oscillation state in accordance with the waveform applied from the switch circuit 96 to the ejection drive element 28, and ink droplets with a size in accordance with the oscillation state are ejected from the nozzles 27*a* in the cases other than the non-ejection (minute oscillation).

Next, description will be given of a configuration of a non-contact power supply system provided in the liquid ejecting system with a charging function with reference to FIG. 13. The non-contact power supply system is formed of the control circuit 53 and the non-contact power receiving circuit 57 on the side of the printer 11 and the power supply device 30.

Figure 13:
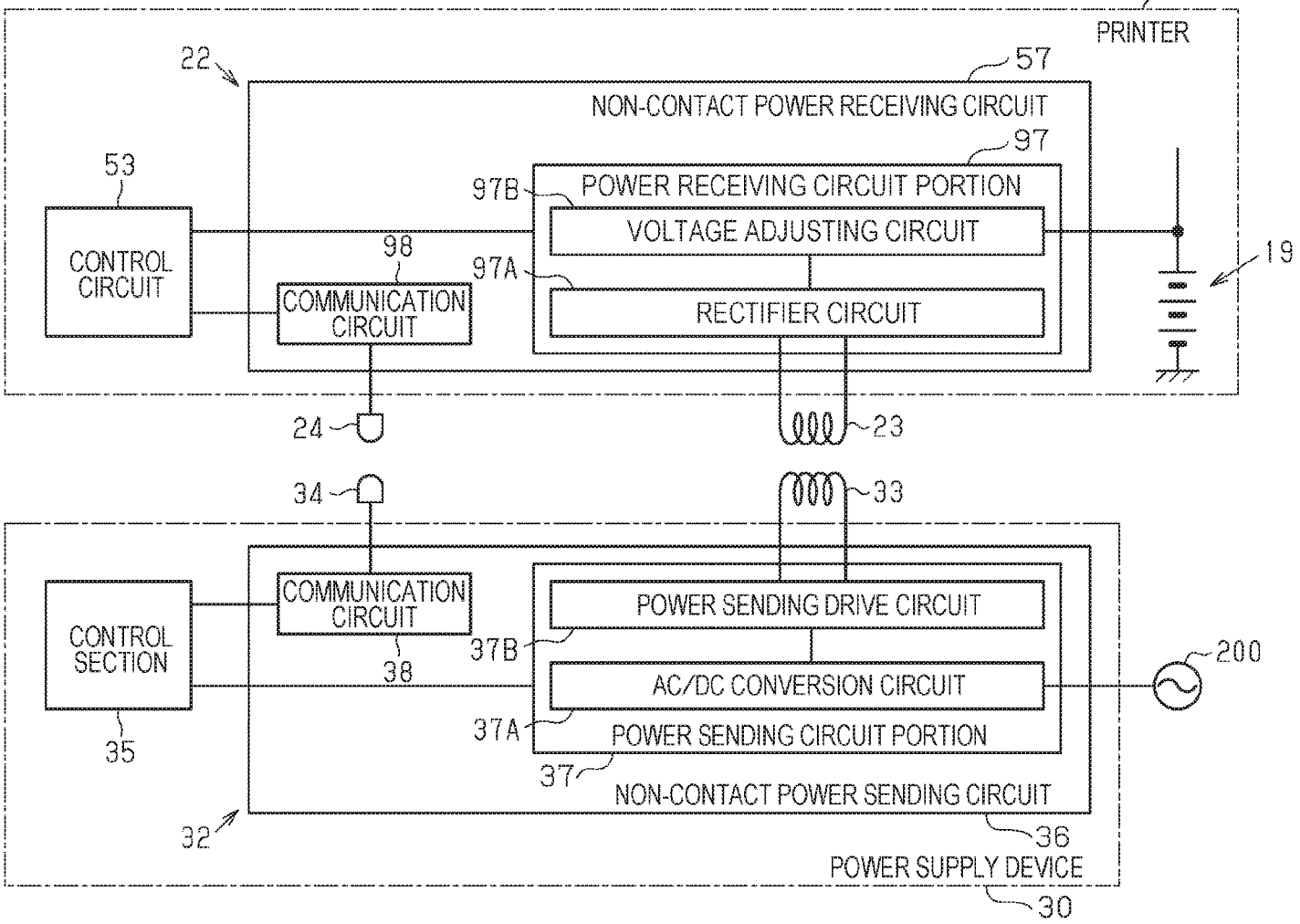
FIG. 13 is a block diagram illustrating an electrical configuration of a power supply system in the liquid ejecting system.

As illustrated in FIG. 13, the power supply device 30 includes the control section 35 and the non-contact power sending circuit 36. The non-contact power sending circuit includes a power sending circuit section 37 and a communication circuit 38. The power sending circuit section includes an AC/DC conversion circuit 37A (AC/DC converter) that converts an AC power with a predetermined voltage from the commercial AC power source 200 into a DC power with a predetermined voltage and a power sending drive circuit 37B that converts the DC power at the predetermined voltage output from the AC/DC conversion circuit 37A into a current at a predetermined frequency and supplies the current to the power sending section 33 (power sending coil). The communication circuit 38 performs communication processing including generation of a transmission signal to be transmitted by the communication section 34 and conversion of a signal received by the communication section into a signal that can be processed by the control section 35. The power sending circuit section 37 and the communication circuit 38 are controlled by the control section 35. An external component (AC/DC adaptor) that is connected to the commercial AC power source 200 outside the power supply device 30 may be used instead of the AC/DC conversion circuit 37A.

As illustrated in FIG. 13, the non-contact power receiving circuit 57 as an example of the power transmission unit includes a power receiving circuit section 97 and a communication circuit 98. The non-contact power receiving circuit 57 includes a rectifier circuit 97A that rectifies the current at the predetermined frequency received by the power receiving section 23 and a voltage adjustment circuit 97B that adjusts (lowers) the current rectified by the rectifier circuit 97A to a predetermined voltage. The battery 19 is charged with the current at the predetermined voltage output by the voltage adjustment circuit 97B. The communication circuit 98 performs communication processing including generation of a transmission signal to be transmitted by the communication section 24 for communication between the communication sections 24 and 34 and conversion of a signal received by the communication section 24 into a signal that can be processed by the control circuit 53. In addition, the power receiving circuit section 97 and the communication circuit 98 are controlled by the control circuit 53.

When the power supply device 30 is made to supply power, for example, the control circuit 53 provides an instruction for starting the power supply to the control section 35 by communication between the communication sections 24 and 34. The control section 35 receives the instruction for starting the power supply, then drives the power sending circuit section 37 of the non-contact power sending circuit 36 to supply the current at the predetermined frequency to the power sending section 33, and thus starts non-contact power supply between the power sending section 33 and the power receiving section 23. When the power supply by the power supply device 30 is stopped, for example, the control circuit 53 provides an instruction (request) for stopping the power supply to the control section 35 by communication between the communication sections 24 and 34. The control section 35 receives the instruction (request) for stopping the power supply, then stops the driving of the power sending circuit section 37 of the non-contact power sending circuit 36 to stop the supply of the current at the predetermined frequency to the power sending section 33, and thus stops the non-contact power supply between the power sending section 33 and the power receiving section 23.

The control circuit 53 performs exclusive control so as to drive one of the drive signal generation circuit 58 and the power receiving unit 22 with priority and restrict drive of the other in a case where the driving timing of the drive signal generation circuit 58 of the circuit substrate overlaps with the power receiving unit 22 (power receiving circuit). For the exclusive control, the control circuit 53 provides an instruction about the exclusive control to the control section 35 by wireless communication between the communication sections 24 and 34.

In a case of restricting the drive of the other as a result of placing priority to the drive of one of the drive signal generation circuit 58 of the circuit substrate and the non-contact power receiving circuit 57 of the power receiving unit 22 in the exclusive control, the restriction of the drive of the other may be performed in two ways, namely a case of stopping the drive and a case of switching content of the drive from first content of drive with no restriction to second content of drive with partial restriction.

In a case of receiving a request for transmitting power (a request for receiving power) to drive the non-contact power receiving circuit 57 during the driving of the drive signal generation circuit 58 or a request for generating a drive signal to drive the drive signal generation circuit 58 during the diving of the non-contact power receiving circuit 57, the control circuit 53 performs the exclusive control in the following two ways. One of the ways is a case where the driving (generation of the drive signal) of the drive signal generation circuit 58 is performed with propriety and the power transmission (power receiving) by the non-contact power receiving circuit 57 is restricted. The other way is a case where the power transmission (power receiving) by the non-contact power receiving circuit 57 is performed with priority and the drive (generation of the drive signal) by the drive signal generation circuit 58 is restricted.

Next, description will be given of exclusive control performed by the control circuit 53 on the non-contact power receiving circuit 57 and the drive signal generation circuit 58 with reference to FIGS. 11 and 12.

Figure 11:
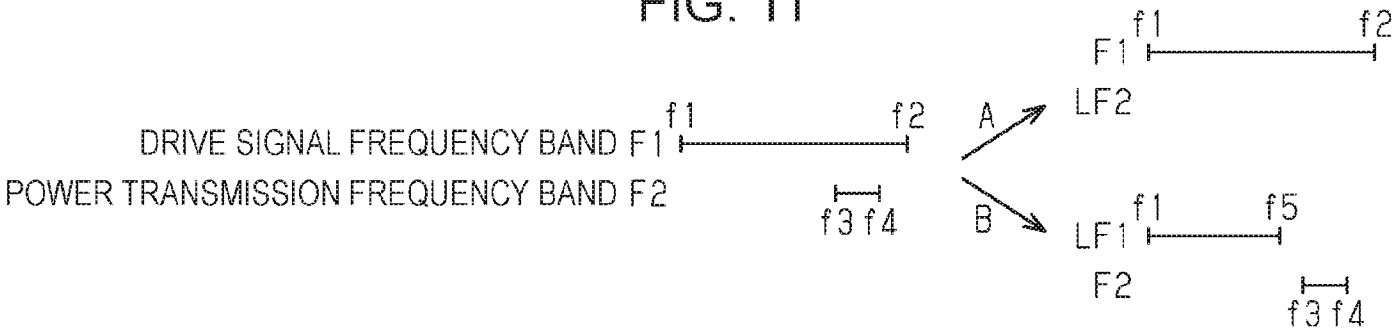
FIG. 11 is an explanatory diagram schematically illustrating exclusive control in a case where an entire power transmission frequency band is included in a drive signal frequency band.

FIG. 11 illustrates an exemplary case where the entire power transmission frequency band F2 of the non-contact power receiving circuit 57 is included in the drive signal frequency band F1 of the drive signal generation circuit 58. FIG. 12 illustrates an exemplary case where a part of the power transmission frequency band F2 of the non-contact power receiving circuit 57 is included in the drive signal frequency band F1 of the drive signal generation circuit 58.

Figure 12:
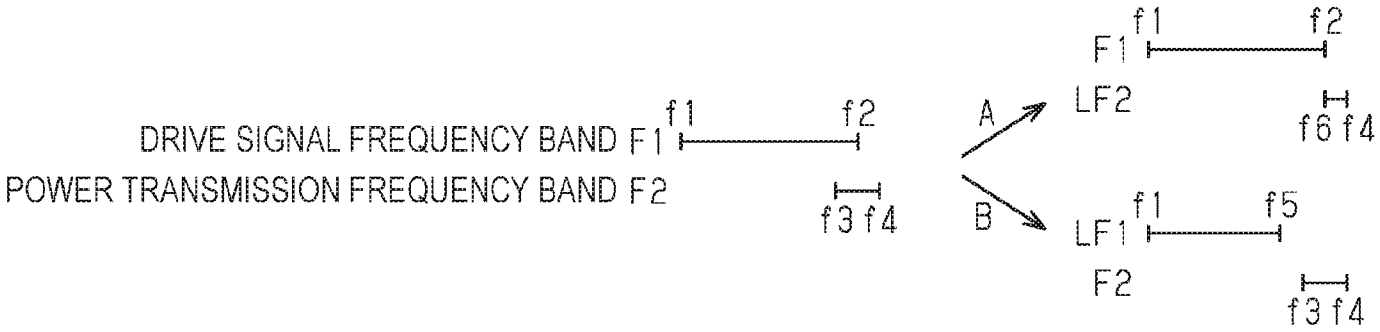
FIG. 12 is an explanatory diagram schematically illustrating exclusive control in a case where only a part of the power transmission frequency band is included in the drive signal frequency band.

The drive signal frequency band F1 and the power transmission frequency band F2 in the case where the exclusive control is performed will be shown on the right side in FIGS. 11 and 12. The exclusive control includes a mode A in which the drive signal COM is generated with priority and power transmission (power receiving) is restricted and a mode B in which the power transmission (power receiving) is performed with priority and the generation of the drive signal COM is restricted. The ordinary (non-overlapping state) drive signal frequency band F1 illustrated on the left side in FIG. 11 is a frequency band within a range from f1 to f2, and the ordinary power transmission frequency band F2 is a frequency band within a range from f3 to f4 (where f3>f1, f4<f2). The ordinary (non-overlapping state) drive signal frequency band F1 illustrated on the left side in FIG. 12 is a frequency band within a range from f1 to f2, and the ordinary power transmission frequency band F2 is a frequency band within a range from f3 to f4 (where f1<f3<f2, f4>f2). In a case of the mode A in which the drive signal is generated with priority and the power transmission (power receiving) by the power receiving unit 22 is restricted in the exclusive control, the frequency band is switched from the ordinary power transmission frequency band F2 with no restriction to a restricted frequency band LF2. In contrast, in a case of the mode B in which the power transmission (power receiving) by the power receiving unit 22 is performed with priority and the generation of the drive signal COM is restricted in the exclusive control, the frequency band is switched from the ordinary drive signal frequency band F1 with no restriction to a restricted frequency band LF1.

In the mode A in the example illustrated in FIG. 11, the drive signal frequency band F1 is maintained at the ordinary frequency band, and the power transmission is stopped. In contrast, in the mode B in the example illustrated in FIG. 11, the frequency band is switched from the ordinary drive signal frequency band F1 set in the frequency range from f1 to f2 (from 1 to 8 MHz, for example) to the restricted frequency band LF1 within a frequency range from f1 to f5 (where f5<f3) (from 1 to 6 MHz, for example).

In the mode A in the example illustrated in FIG. 12, the drive signal frequency band F1 is maintained at the ordinary frequency band, and the ordinary power transmission frequency band F2 set within a frequency range from f3 to f4 (6.78±0.15 MHz, for example) is switched to the restricted frequency band LF2 within a frequency range from f5 to f4 (where f5>f3) (from 6.78 to 6.78±0.15 MHz, for example). That is, specifically, the frequency band of 6.78±0.15 MHz used for A4WP as a non-contact charging standard of a resonance-type wireless power supply scheme is switched to a restricted frequency band from 6.78 to 6.78±0.15 MHz, for example. In contrast, in the mode B in the example illustrated in FIG. 12, the ordinary drive signal frequency band F1 set within the frequency range from f1 to f2 (from 1 to 8 MHz, for example) is switched to the restricted frequency band LF1 within the frequency range from f1 to f6 (where f6<f3) (from 1 to 6 MHz, for example).

Here, specifically, the ordinary frequency band F1 from 1 to 8 MHz, for example, is switched to the restricted frequency band LF1 from 1 to 6 MHz, for example in the example in which the drive signal frequency band F1 is restricted. The restricted frequency band does not include the frequency band (6.78±0.15 MHz) used for A4WP as the non-contact charging standard of the resonance-type wires power supply scheme. Therefore, a restricted frequency band from 1 to 6.6 MHz or from 1 to 5 MHz may be used as long as the frequency band used for the wireless power supply scheme is avoided. In a case of using another wireless power supply scheme, it is preferable to switch the frequency band to a restricted frequency band by avoiding a frequency band used for the wireless power supply scheme. The restricted frequency bands LF1 and LF2 are not limited to the aforementioned restricted frequency ranges, and it is possible to switch the frequency bands to restricted frequency bands LF1 and LF2 that do not overlap the drive signal frequency band F1 and the power transmission frequency band F2. In the embodiment, the frequency band (6.78±0.15 MHz, for example) used for the wireless power supply scheme corresponds to an example of the "first frequency band", and the frequency band (from 1 to 8 MHz, for example) used as the switching frequency (the frequency of the modulation signal) when the drive signal generation circuit 58 generates the drive signal corresponds to an example of the "second frequency band". At least a part of the first frequency band is included in the second frequency band. That is, the first frequency band and the second frequency band at least partially overlap with each other.

A plurality of printing modes are set in the printer 11. The printing modes in this example include at least a draft mode and a high-definition mode. The draft mode is a mode in which priority is placed on a printing speed instead of printing quality, and printing is performed by ejecting large dot ink droplets with first resolution that is relatively low resolution. In contrast, the high-definition mode is a mode in which priority is placed on the image quality instead of the printing speed, and printing is performed by ejecting small or intermediate dot ink droplets with relatively high second resolution.

Here, the amount of large dot ink droplets does not greatly vary depending on a rate of disruption of the waveform even if the waveform of the drive signal is slightly disrupted by an interference due to a frequency during the power transmission. As a result, the dot size does not relatively easily vary in the case of the large ink dots. In contrast, the amount of ink droplets significantly varies depending on the rate of the disruption of the waveform if the waveform of the drive signal is disrupted by interference due to the frequency during the power transmission. As a result, the dot size relatively easily varies in the case of the small ink dots. In contrast, the dot size of the intermediate dots relatively easily varies in a case where the waveform of the drive signal is slightly disrupted by interference due to the frequency during the power transmission as compared with the large dots though not to the extent of the small dots. Therefore, the control circuit 53 according to the embodiment does not perform the exclusive control in a case where the printing mode is the draft mode, and performs the exclusive control in a case where the printing mode is the high-definition mode. A configuration is also applicable in which the exclusive control is performed regardless of the printing modes instead of the configuration in which whether or not to perform the exclusive control in accordance with the printing modes.

Description will be given of effects of the printer 11 as an example of the liquid ejecting apparatus.

In a case where the user desires to charge the printer 11, the user installs the printer 11 on the pad 31 of the power supply device 30. If the printer 11 is arranged at an appropriate position on the pad 31, the power sending section 33 of the power sending unit 32 on the side of the pad 31 and the power receiving section 23 of the power receiving unit 22 on the side of the printer 11 are arranged so as to face each other in a non-contact state. At this time, the communication sections 24 and 34 are arranged so as to face each other in a non-contact state, and the control circuit 53 and the control section 35 communicate with each other via the communication sections 24 and 34. The control circuit 53 recognizes a state where the charging by the power supply device 30 is possible through the communication. The control circuit 53 similarly recognizes that the charging by the power supply device 30 is possible even in a case where the power source of the printer 11 in the state of being installed on the pad 31 of the power supply device 30 is turned on. Furthermore, if the state of the battery 19 is checked and is determined to be a state other than a completely charged state, and conditions for charging are met, then the control circuit 53 determines that the request for transmitting power (the request for receiving power) has been made.

The control circuit 53 determines a mode for determining which of the power transmission processing and the drive signal generation processing is to be performed with priority. The mode is selected in accordance with user selection, a charged state of the battery 19, a printing mode, and the like, or one mode is determined for each model in advance.

If the user provides an instruction for performing printing to the printer 11 by an operation of the operation unit 15 or an operation of a keyboard or a mouse of the host device 100, a print drive in the host device 100 generates a print job and transmits the print job to the printer 11. If the user provides an instruction for performing printing by operating the operation unit 15, then a print job is internally generated in response to the instruction. The control circuit 53 also receives the print job as a request for generating a drive signal necessary for performing printing based on the print job.

Figure 14:
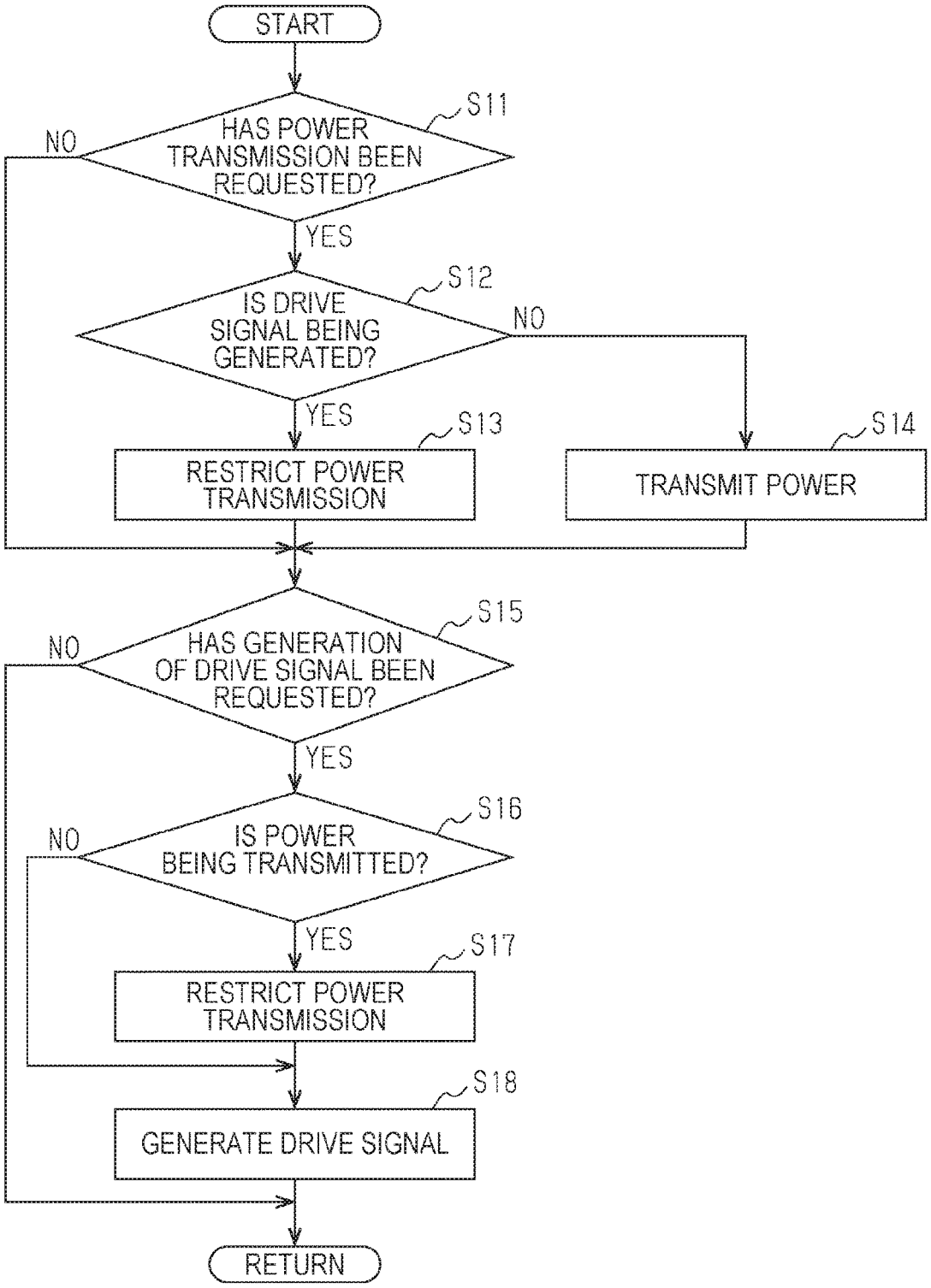
FIG. 14 is a flowchart illustrating exclusive control that places priority on drive signal generation processing.
Figure 15:
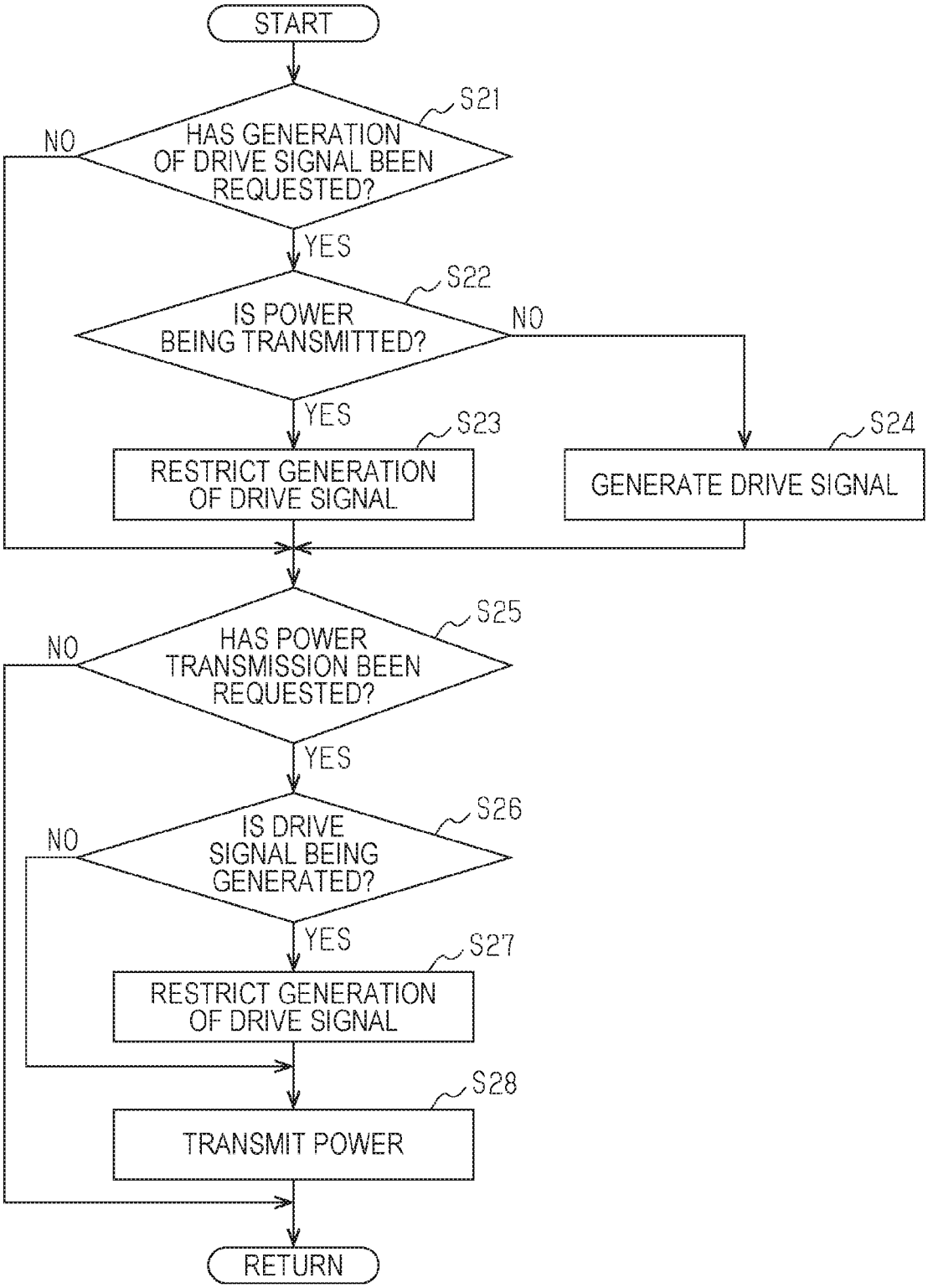
FIG. 15 is a flowchart illustrating exclusive control that places priority on power transmission processing.

Hereinafter, description will be given of the exclusive control of the power transmission processing (power receiving processing) and the drive signal generation processing performed by the control circuit 53 with reference to the flowcharts illustrated in FIGS. 14 and 15. The exclusive control according to the embodiment includes a mode A in which the drive signal is generated with priority as illustrated in FIG. 14 and a mode B in which the power transmission is performed with priority as illustrated in FIG. 15, and the control circuit 53 executes any one of the modes. First, description will be given of the exclusive control in the mode A in which the priority is placed not on the power transmission but on the generation of the drive signal with reference to FIG. 14.

First, it is determined in Step S11 whether or not a request for transmitting power has been made. When the user installs the printer 11 in a power on state on the installation surface 31A of the power supply device 30 or turns on the power source of the printer 11 installed on the installation surface 31A of the power supply device 30, for example, the control circuit 53 recognizes that the charging by the power supply device 30 is possible through communication between the communication sections 24 and 34. Furthermore, if the state of the battery 19 is checked and is determined to be a state other than a completely charged state, and conditions necessary for charging are met, then the control circuit 53 determines that a request for transmitting power has been made. If the request for transmitting power has been made, the processing proceeds to Step S12. If the request for transmitting power has not been made, the processing proceeds to Step S15.

In Step S12, it is determined whether or not the drive signal is being generated. When printing processing based on a print job is being executed, it is determined that the drive signal necessary for the printing is being generated. If the drive signal is being generated, the processing proceeds to Step S13. If the drive signal is not being generated, the processing proceeds to Step S14.

In Step S13, the power transmission is restricted. In the embodiment, the restriction of the power transmission includes a case where the power transmission is stopped and a case where the power is transmitted using a restricted frequency band. In the example illustrated in FIG. 11, for example, the control circuit 53 provides an instruction for restricting the power transmission to the control section 35, and the control section 35 stops the driving of the non-contact power sending circuit 36 in the ordinary frequency band (from f3 to f4 (6.78±0.15 MHz, for example)). As a result, the power supply from the power sending section 33 of the power supply device 30 to the power receiving section 23 on the side of the printer 11 in a non-contact manner is stopped. In the example illustrated in FIG. 12, the control circuit 53 provides an instruction for restricting the power transmission to the control section 35, and the control section 35 switches the frequency band used by the non-contact power sending circuit 36 from the ordinary frequency band (from f3 to f4 (6.78±0.15 MHz, for example)) to the restricted frequency band (from f6 to f4 (from 6.78 MHz to 6.78+0.15 MHz, for example)). As a result, the wireless power supply is continued in the restricted frequency band that does not include the frequency band of 6.78±0.15 MHz used for A4WP as the standard of the resonance-type wireless power supply scheme.

In Step S14, power is transmitted. The control circuit 53 provides an instruction for supplying power (power supply) to the control section 35 of the power supply device 30 via wireless communication between the communication sections 34 and 24. The control section 35 receives the instruction, then drives the non-contact power sending circuit 36, and supplies power in the ordinary frequency band of 6.78±0.15 MHz. As a result, the power supply from the power sending section 33 of the power supply device 30 to the power receiving section 23 of the printer 11 in a non-contact manner is performed, and the battery 19 on the side of the printer 11 is charged.

In Step S15, it is determined whether or not a request for generating the drive signal has been made. The control circuit 53 determines that the request for generating the drive signal has been made based on reception of a print job. If the request for generating the drive signal, the processing proceeds to Step S16. If the request for generating the drive signal has not been made, the routine is completed.

In Step S16, it is determined whether or not power is being transmitted. The control circuit 53 determines that power is being transmitted when the power sending section 33 of the power supply device 30 is supplying power to the power receiving section 23 of the printer 11. If the power is being transmitted, then the processing proceeds to Step S17. If the power is not being transmitted, the processing proceeds to Step S18.

In Step S17, the power transmission is restricted. That is, in a case where power is being transmitted in the ordinary frequency band (6.78±0.15 MHz) when the request for generating the drive signal is received (positive determination in S15), the frequency band used for the power to be transmitted is switched from the ordinary frequency band to the restricted frequency band. In the example illustrated in FIG. 11, for example, the frequency band is switched from the ordinary frequency band (from f3 to f4) to the restricted frequency band (0) in the mode A, that is, the power transmission (power receiving) is stopped. In the example illustrated in FIG. 12, the frequency band is switched from the ordinary frequency band (from f3 to f4) to the restricted frequency band (from f6 to f4) in the mode A. At this time, the frequency band is switched from the frequency band of 6.78±0.15 MHz, for example, to the frequency band from 6.78 to 6.78+0.15 MHz obtained by excluding the range overlapping the drive signal frequency band F1 from the frequency band of 6.78±0.15 MHz.

Returning to FIG. 14, the drive signal is generated in Step S18. The control circuit 53 drives the drive signal generation circuit 58 in the head control circuit 54 and generates the drive signal COM. The drive signal COM is transferred from the drive signal generation circuit 58 to the head substrates 51 in the unit heads 26. The head substrates 51 drive the ejection drive elements 28 (piezoelectric elements 170) via the head drive circuit 90 based on the input print data SI and SP and the drive signal COM, and ink is ejected from the nozzles 27*a* of the ejecting sections D.

When timing at which the drive signal generation processing is performed overlaps timing at which the power transmission processing is performed as described above, the exclusive control of performing the drive signal generation processing with priority is performed. As a result, it is possible to avoid inappropriate charging (power supply) such as excessive charging or insufficient charging and in appropriate generation of the drive signal due to resonance or the like that can occur in a case where the frequency band for transmitting power and the frequency band for generating the waveform of the drive signal at least partially overlap each other. When the drive signal generation circuit 58 on which priority is placed in the exclusive control is being driven, the non-contact power receiving circuit 57 is stopped, or is driven in the frequency band restricted such that frequency bands used do not overlap each other. In the case where the printer is driven in the restricted frequency band as described above, it is possible to maintain the charging of the battery 19 even while the battery 19 is being charged by the printer 11 receiving power from the power supply device 30 and to perform printing based on the print job requested by the user.

Next, description will be given of exclusive control in the mode B in which priority is placed not on generation of a drive signal but on power transmission with reference to FIG. 15.

First, it is determined in Step S21 whether or not a request for generating a drive signal has been made. If the request for generating the drive signal has been made, the processing proceeds to Step S22. If the request for generating the drive signal has not been made, the processing proceeds to Step S25.

In Step S22, it is determined whether or not power is being transmitted. If the power is being transmitted, the processing proceeds to Step S23. If the power is not being transmitted, the processing proceeds to Step S24.

In Step S23, the generation of the drive signal is restricted. In the embodiment, the restriction of the generation of the drive signal includes a case where the generation of the drive signal is stopped and a case where the switching frequency for generating the waveform of the drive signal is restricted and the drive signal is generated. In the latter case, the used frequency band is switched from the ordinary frequency band to the restricted frequency band for generating the drive signal. In the example illustrated in FIG. 11, for example, the frequency band is switched from the ordinary frequency band (from f1 to f2 (1 to 8 MHz, for example)) to the restricted frequency band (from f1 to f5 (1 to 6 MHz, for example)). The restricted frequency band does not include the frequency band of 6.78±0.15 MHz used for A4WP as the standard of the resonance-type wireless power supply scheme. The restricted frequency may be from 1 to 6.6 MHz or from 1 to 5 MHz. In a case of using another wireless power supply scheme, it is preferable that the restricted frequency band of the drive signal is within a range that does not include the frequency band used for the wireless power supply scheme.

In Step S24, the drive signal is generated. In such a case, the control circuit 53 drives the drive signal generation circuit 58 and generates the drive signal in the ordinary frequency band. In the example illustrated in FIG. 11, for example, the drive signal COM is generated in the drive signal frequency band F1 (from f1 to f2 (1 to 8 MHz, for example)). In the example illustrated in FIG. 12, the drive signal COM is generated in the drive signal frequency band F1 (from f1 to f2 (1 to 6.78 MHz, for example)).

In Step S25, it is determined whether or not a request for transmitting power has been made. If the request for transmitting power has been made, the processing proceeds to Step S26. If the request for transmitting power has not been made, the routine is completed.

In Step S26, it is determined whether or not the drive signal is being generated. If the drive signal is being generated, the processing proceeds to Step S27. If the drive signal is not being generated, the processing proceeds to Step S28.

In Step S27, the generation of the drive signal is restricted. That is, in a case where the drive signal is being generated in the ordinary frequency band when the request for transmitting power has been made, the frequency band used for the drive signal is switched from the ordinary frequency band (from 1 to 8 MHz, for example) to the restricted frequency band (from 1 to 6 MHz, for example). In the example illustrated in FIGS. 11 and 12, the frequency band used for the drive signal is switched from the ordinary frequency band (from f1 to f2 (from 1 to 8 MHz or from 1 to 6.78 MHz, for example)) to the restricted frequency band (from f1 to f5 (from 1 to 6 MHz, for example)).

In Step S28, power is transmitted. The control circuit 53 communicates with the control section 35 on the side of the power supply device 30 via the communication sections 24 and 34 and provides an instruction for supplying power to the control section 35. The control section 35 receives the instruction for supplying power and then drives the non-contact power sending circuit 36. As a result, the power is supplied from the power supply device 30 to the printer 11 via the power sending section 33 and the power receiving section 23 in a non-contact manner, and the battery 19 on the side of the printer 11 is charged with the supplied power.

When timing at which the drive signal generation processing is performed overlaps with timing at which the power transmission processing is performed, the exclusive control of performing the power transmission processing with priority is performed. As a result, it is possible to avoid inappropriate charging (power supply) such as excessive charging and insufficient charging due to resonance or the like that can occur in a case where the frequency band for transmitting power and the frequency band for generating the waveform of the drive signal at least partially overlap each other. The drive signal generation circuit 58 is stopped or the driving of the drive signal generation circuit 58 is continued in the restricted frequency band even if the request for generating the drive signal is made while the non-contact power receiving circuit 57 on which priority is to be placed in the exclusive control is being driven, or if the drive signal is being generated when the request for transmitting power is made. As a result, it is possible to avoid inappropriate charging (power supply) such as excessive charging and insufficient charging and inappropriate generation of the drive signal due to resonance or the like that can occur in a case where the frequency band for transmitting power and the frequency band for generating the waveform of the drive signal at least partially overlap each other. It is possible to maintain charging of the battery 19 and to perform printing based on the drive signal COM with the waveform generated at the restricted frequency in a case where the driving of the drive signal generation circuit 58 is continued at the restricted frequency.

According to the first embodiment described above in detail, the following effects can be achieved.

(1) The printer 11 includes the drive signal generation circuit 58 that generates the drive signal COM by using the second frequency band that includes at least a part of the first frequency band and the non-contact power receiving circuit 57 that transmits power in a non-contact manner by using the first frequency band. The control circuit 53 performs the exclusive control of performing one of the drive signal generation processing and the power transmission processing with priority and restricts the other when the timing at which the drive signal generation processing is performed by the drive signal generation circuit 58 is performed overlaps with the timing at which the power transmission processing is performed by the non-contact power receiving circuit 57. Therefore, it is possible to suppress electrical interference such as resonance between an electromagnetic wave for transmitting power and electromagnetic wave noise generated when the drive signal COM is generated. Accordingly, it is possible to realize both the improvement in printing quality and the appropriate charging.

(2) The control circuit 53 restricts the power transmission (power receiving) by the non-contact power receiving circuit 57 in a case where the drive signal COM is being generated by the drive signal generation circuit 58. Therefore, the drive signal COM is generated with priority, the generation of the drive signal COM in the ordinary frequency band is continued, and the power transmission is restricted even if the request for transmitting power is received during the printing. Accordingly, it is possible to stabilize the printing quality.

(3) The control circuit 53 restricts the generation of the drive signal COM by the drive signal generation circuit 58 in a case where the power is being transmitted (power receiving) by the non-contact power receiving circuit 57. Therefore, the power is transmitted with priority and the generation of the drive signal COM is restricted even if the printer 11 receives the request for printing while the power is being transmitted from the power supply device 30 to the printer 11 in a non-contact manner (during the charging, for example). Accordingly, it is possible to enhance stability of the power transmission, to suppress excessive charging, insufficient charging, and the like of the battery 19 of the printer 11, for example, due to an electrical interference such as resonance, and to appropriately charge the battery 19.

(4) The printer 11 includes the case body 12 that surrounds the circuit substrate 25 on which the drive signal generation circuit 58 is mounted ad the power receiving unit 22 that includes the non-contact power receiving circuit 57, and has the first surface 41 and the second surface 42 that faces the first surface 41. The drive signal generation circuit 58 is arranged at a position closer to the first surface 41 than to the second surface 42, and the non-contact power receiving circuit 57 is arranged at a position closer to the second surface 42 than to the first surface 41. Accordingly, it is possible to arrange the drive signal generation circuit 58 and the non-contact power receiving circuit 57 so as to be separate from each other in the case body 12 and to suppress electrical interference therebetween.

(5) The non-contact power receiving circuit 57 transmits power from the power supply device 30 as an example of the apparatus outside the liquid ejecting apparatus to the printer 11. Therefore, it is possible to supply power from the power supply device 30 to the printer 11 in a non-contact manner. If the printer 11 is installed on the power supply device 30 and is then used, the control circuit 53 can provide a request for supply power to the control section 35 of the power supply device 30 when charging is required, the printer 11 can be charged with the power supplied from the power supply device 30, and it is possible to realize high printing quality and appropriate charging by performing the exclusive control during the printing.

(6) The drive signal generation circuit 58 includes an amplifier circuit using a digital amplifier. Therefore, it is possible to avoid interference (resonance, for example) even in the high-frequency band of the digital amplifier.

(7) The second frequency band includes a band from 1 to 8 MHz. In a case where a frequency band necessary for generating the drive signal COM is from 1 to 8 MHz, it is possible to avoid electrical interface such as resonance even if at least a part of the first frequency band for supplying power is included in the second frequency band (from 1 to 8 MHz). When it is desired to steeply change the waveform of the drive signal COM, a high frequency band in the second frequency band is used, and a lower frequency band than the frequency band is used in other cases. Even in a case where the frequency band from 1 to 8 MHz is used, it is possible to avoid electrical interference such as resonance. In a case where it is not necessary to steeply change the waveform or slight deterioration of precision of the steep waveform is allowable, it is possible to avoid interference such as resonance by restricting a part of the second frequency band (the high frequency band, for example) used for generating the drive signal COM.

(8) The control circuit 53 restricts the second frequency band to the restricted frequency at which the drive signal COM can be generated without using the first frequency band. In a case where the control circuit 53 restricts the generation of the drive signal COM, the drive signal generation circuit 58 uses the restricted frequency band excluding the first frequency band in the second frequency band to generate the drive signal COM. Accordingly, it is possible to generate the drive signal COM and to perform printing by using the restricted frequency band excluding the first frequency band even if the request for transmitting power is received during the generation of the drive signal (during the printing, for example) or the request for printing is received during the power transmission (during the charging, for example).

(9) The control circuit 53 restricts the generation of the drive signal COM by switching the frequency band used by the drive signal generation circuit 58 for generating the drive signal COM from the ordinary frequency band (drive signal frequency band F1) to the restricted frequency band LF2 (the mode B in FIGS. 11 and 12). Accordingly, it is possible to stably supply power and to perform printing with slightly degraded printing quality without being significantly influenced by electrical interference such as resonance when the power is transmitted from the power supply device 30 to the printer 11.

(10) In a case where power is being transmitted by the non-contact power transmission circuit, the control circuit 53 restricts the generation of the drive signal by the drive signal generation circuit 58 in the draft mode and does not restrict the generation of the drive signal by the drive signal generation circuit 58 in the high-definition mode. Accordingly, it is possible to relatively avoid the unnecessary restriction of the drive signal generation circuit 58 and to obtain a printing result with printing quality in accordance with the printing mode.

(11) In a case where the control circuit 53 restricts the power transmission by stopping the power transmission (power receiving) by the non-contact power receiving circuit 57 (the mode A in FIG. 11), it is possible to suppress electrical interference between the drive signal generation circuit 58 and the non-contact power receiving circuit 57 and to realize an improvement in printing quality.

(12) In a case where the control circuit 53 restricts the generation of the drive signal COM by stopping the generation of the drive signal COM by the drive signal generation circuit 58, it is possible to suppress electrical interference between the drive signal generation circuit 58 and the non-contact power receiving circuit 57 and to realize appropriate charging.

(13) As the non-contact power receiving circuit 57, the non-contact power receiving circuit 57 that receives power supply from the power supply device 30 as the apparatus outside the liquid ejecting apparatus is provided. Accordingly, the printer 11 can receive power supply from the power supply device 30 by the non-contact power receiving circuit 57.

(14) One of the drive signal generation circuit 58 and the non-contact power receiving circuit 57 is accommodated in the accommodation space SA1 on one side, on which the transport motor 18 as an example of the power source for transport is arranged, from among the accommodation spaces SA1 and SA2 on both sides with the liquid ejectable region interposed therebetween in the longitudinal direction in the case body 12. The other of the drive signal generation circuit 58 and the non-contact power receiving circuit 57 is arranged in the other accommodation space SA2 on the opposite side to the side of the transport motor 18 with the liquid ejectable region interposed therebetween. Accordingly, since the drive signal generation circuit 58 and the non-contact power receiving circuit 57 are arranged so as to be separate from each other on both sides with the liquid ejectable region interposed therebetween in the case body 12, it is possible to suppress electrical interference between both circuits 57 and 58.

(15) The non-contact power receiving circuit 57 is arranged at a position closer to the outer circumferential surface (the bottom surface 45, for example) of the case body 12 than the drive signal generation circuit 58 in the case body 12, the power from the outside of the case body 12 can be easily transmitted (received). Since the drive signal generation circuit 58 is arranged at a further inner side beyond the outer circumferential surface of the case body 12 than the non-contact power receiving circuit 57, the drive signal generation circuit 58 is not easily influenced by the electromagnetic wave for the power transmission (power supply), which is transmitted (sent and received) outside the case body 12.

(16) The drive signal generation circuit 58 and the non-contact power receiving circuit 57 are arranged on opposite sides with the metal frame 47 interposed therebetween. Therefore, emitting of the electromagnetic wave noise in the second frequency band that occurs when the drive signal generation circuit 58 generates the drive signal COM to the non-contact power receiving circuit 57, the power sending section 33, and the power receiving section 23 and emitting of the electromagnetic wave in the first frequency band to be received by the non-contact power receiving circuit 57 to the drive signal generation circuit 58 are blocked by the metal frame 47. Accordingly, it is possible to suppress the drive signal COM from being affected by the electrical interference due to the electromagnetic wave for power transmission and to suppress the electromagnetic wave for power transmission from being affected by electrical interference due to electromagnetic wave noise generated when the drive signal is generated.

(17) In the case body 12, the frame 47 including the metal main frame section 47A that supports the liquid ejecting head 20 and at least one (two, for example) side frame section 47B and 47C that extends in a direction intersecting the longitudinal direction on at least one of both sides of the main frame section 47A in the longitudinal direction is provided. The drive signal generation circuit and the non-contact power receiving circuit 57 are arranged on the opposite sides with at least one side frame section 47B and 47C interposed therebetween. Therefore, emitting of the electromagnetic wave noise in the second frequency band that is generated when the drive signal generation circuit 58 generates the drive signal COM to the non-contact power receiving circuit 57 and emitting of the electromagnetic wave in the first frequency band to be received by the non-contact power receiving circuit 57 to the drive signal generation circuit 58 are blocked by the side frame sections 47B and 47C. Accordingly, it is possible to more effectively suppress electrical interference between the drive signal generation circuit 58 and the non-contact power receiving circuit 57.

(18) In the liquid ejecting system 10 that includes the printer 11 and the power supply device 30, the printer includes the power receiving section 23, and the power supply device 30 includes the power sending section 33 that sends power to the power receiving section 23 in a non-contact manner. The printer 11 can receive the power supplied from the power sending section 33 of the power supply device 30 by the power receiving section 23 in a non-contact manner. Accordingly, it is possible to charge the printer 11 with the power supplied from the power supply device 30.

Second Embodiment

Next, description will be given of a second embodiment of a liquid ejecting apparatus and a liquid ejecting system with a charging function with reference to drawings. According to the second embodiment, the liquid ejecting apparatus includes a power supply device (power sending unit), and another electronic device is charged by installing this another electronic device on an installation section provided at a part of a case body 12 and supply power to this another electronic device. Therefore, the liquid ejecting apparatus includes a non-contact power sending circuit, and this another electronic device includes a non-contact power receiving circuit in the second embodiment.

Figure 16:
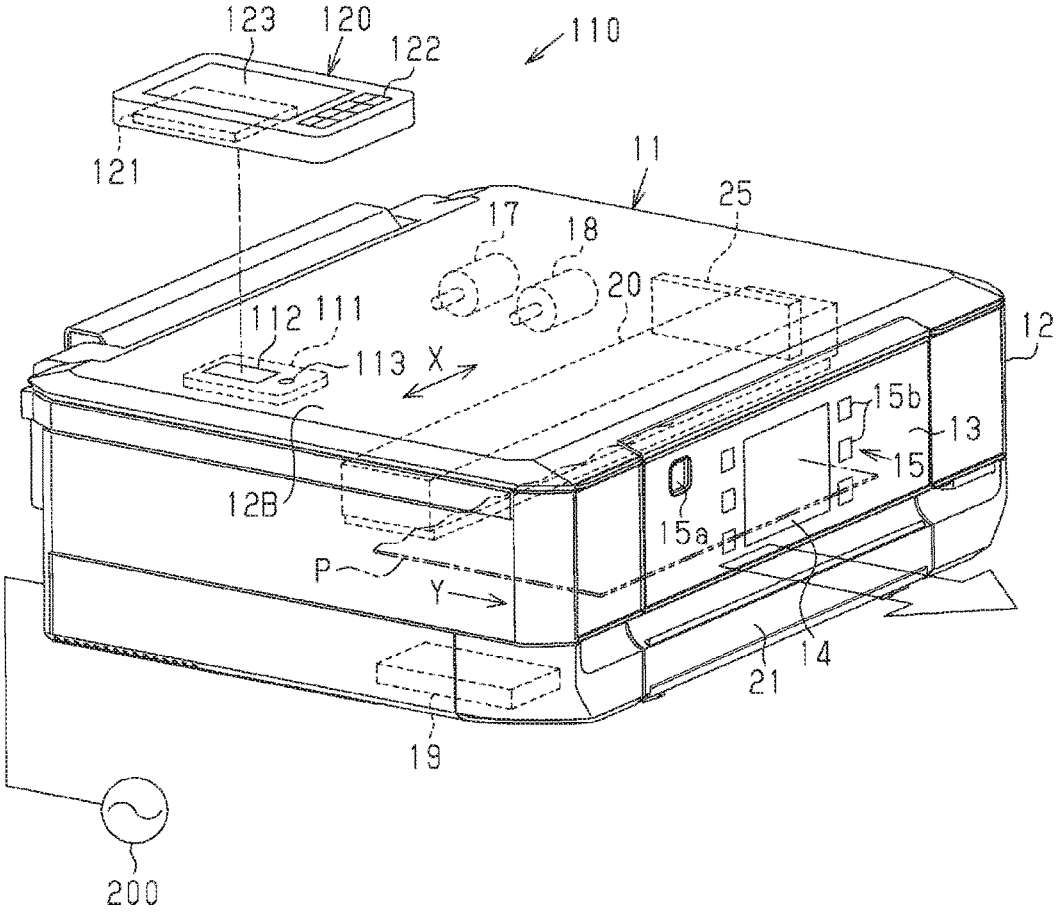
FIG. 16 is a perspective view illustrating a liquid ejecting system with a charging function according to a second embodiment.

As illustrated in FIG. 16, a liquid ejecting system 110 with a charging function includes a printer 11 as an example of the liquid ejecting apparatus and an electronic device 120 with a non-contact power receiving function of receiving power supply from the printer 11 in a non-contact manner. The printer 11 has basically the same configuration as that in the first embodiment and is different from that in the first embodiment in that the printer 11 is provided with a power sending unit 111 for power supply instead of the power receiving unit 22 in the first embodiment. In the embodiment, the electronic device 120 corresponds to "the apparatus outside the liquid ejecting apparatus" to which power is transmitted from the liquid ejecting apparatus.

An installation surface section 12B on which the electronic device 120 can be installed for charging is provided in a surface, which faces the power sending unit 111, of the case body 12 of the printer 11. The power sending section 112 of the power sending unit 111 and the communication section 113 are exposed from the installation surface section 12B. The power sending unit 111 can transmit power at a predetermined voltage, which is obtained by converting AC power input from a commercial AC power source 200 into DC power, to the electronic device 120 installed on the installation surface section 12B in a non-contact manner. The electronic device 120 includes a power receiving unit 121 and a battery 122 (see FIG. 19). As described above, the liquid ejecting system 110 with the charging function according to the embodiment is formed of the printer 11 that includes the power sending unit 111 and the electronic device 120 that includes the power receiving unit 121.

If the electronic device 120 is installed on the installation surface section 12B of the printer 11, power is supplied from the power sending unit 111 for power supply to the electronic device 120 in a non-contact manner. Then, the electronic device 120 is charged with the power supplied from the printer 11. The power sending unit 111 is arranged in such a state that a part thereof is exposed from an upper surface of the printer 11 on a side of an upper surface portion of one of both ends in the width direction X (main scanning direction X) in the case body 12. According to the embodiment, a non-contact power sending circuit 115 corresponds to an example of "the non-contact power transmission circuit" and performs power sending (power supply) as an example of "the power transmission".

Figure 17:
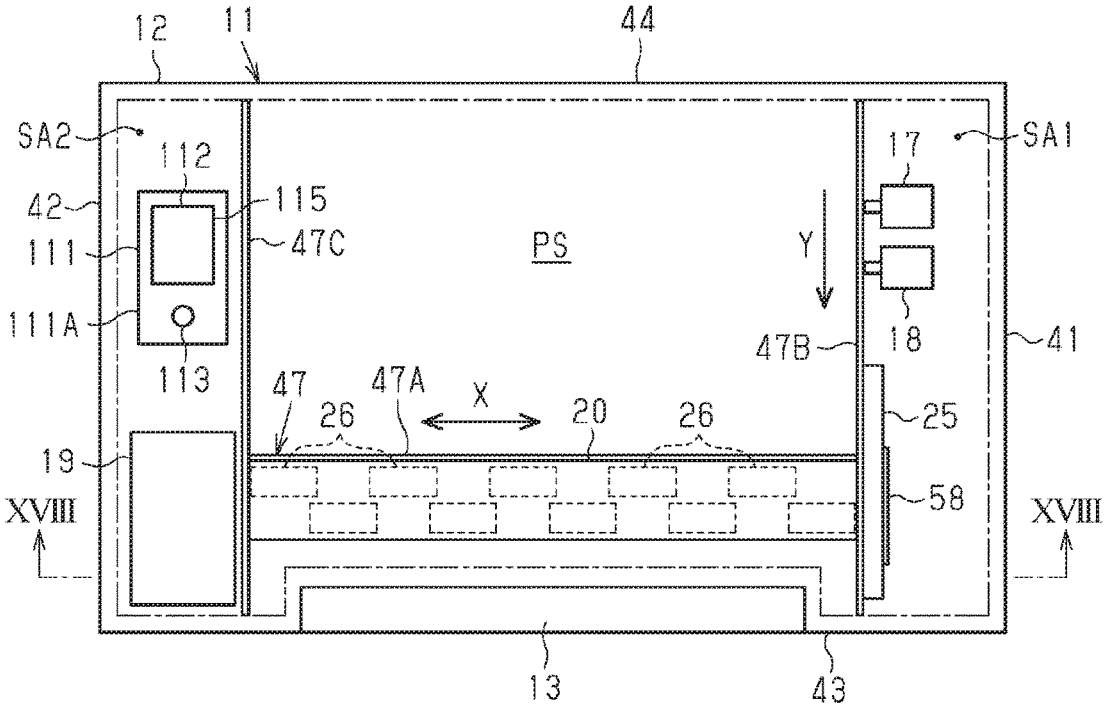
FIG. 17 is a planar sectional view schematically illustrating a layout of components in a printer taken along the line XVII-XVII in FIG. 18.
Figure 18:
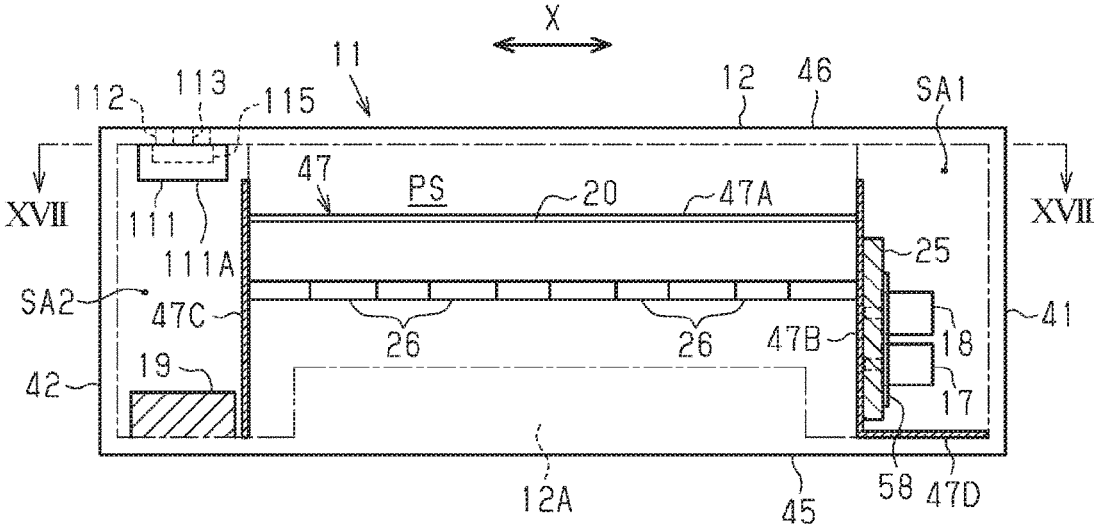
FIG. 18 is a front sectional view schematically illustrating the layout of the components in the printer taken along the line XVIII-XVIII in FIG. 17.

As illustrated in FIGS. 17 and 18, the power sending unit 111 is provided at a position, at which the power sending unit 111 faces the power receiving unit 121 (see FIG. 16), in the upper surface portion of the printer 11 in a state where the electronic device 120 is installed on the installation surface section 12B, such that the power sending section 112 and the communication section 113 provided in a main body 111A are partially exposed.

As illustrated in FIGS. 16 to 18, a circuit substrate 25 on which various circuit sections including the drive signal generation circuit 58 (see FIGS. 6 and 7) for generating a drive signal to be transmitted for causing the liquid ejecting head 20 to eject ink droplets are mounted is provided in the case body 12 of the printer 11 in the same manner as in the first embodiment. In this example, the circuit substrate 25 is arranged at the other end on the opposite side of one end, at which the power sending unit 111 is arranged, in the longitudinal direction (width direction X) of the liquid ejecting head 20 in the case body 12. That is, the circuit substrate 25 on which the drive signal generation circuit 58 is mounted and the power sending unit 111 are respectively arranged at both ends (first and second accommodation spaces SA1 and SA2) on further outer sides beyond both longitudinal end surfaces of the liquid ejecting head 20 in the width direction X in the case body 12.

Next, description will be given of a configuration of a non-contact power supply system provided in the liquid ejecting system 110 with the charging function with reference to FIG. 19. The non-contact power supply system is formed of a control circuit 53 and a non-contact power sending circuit 115 on the side of the printer 11 and the power receiving unit 121 on the side of the electronic device 120.

Figure 19:
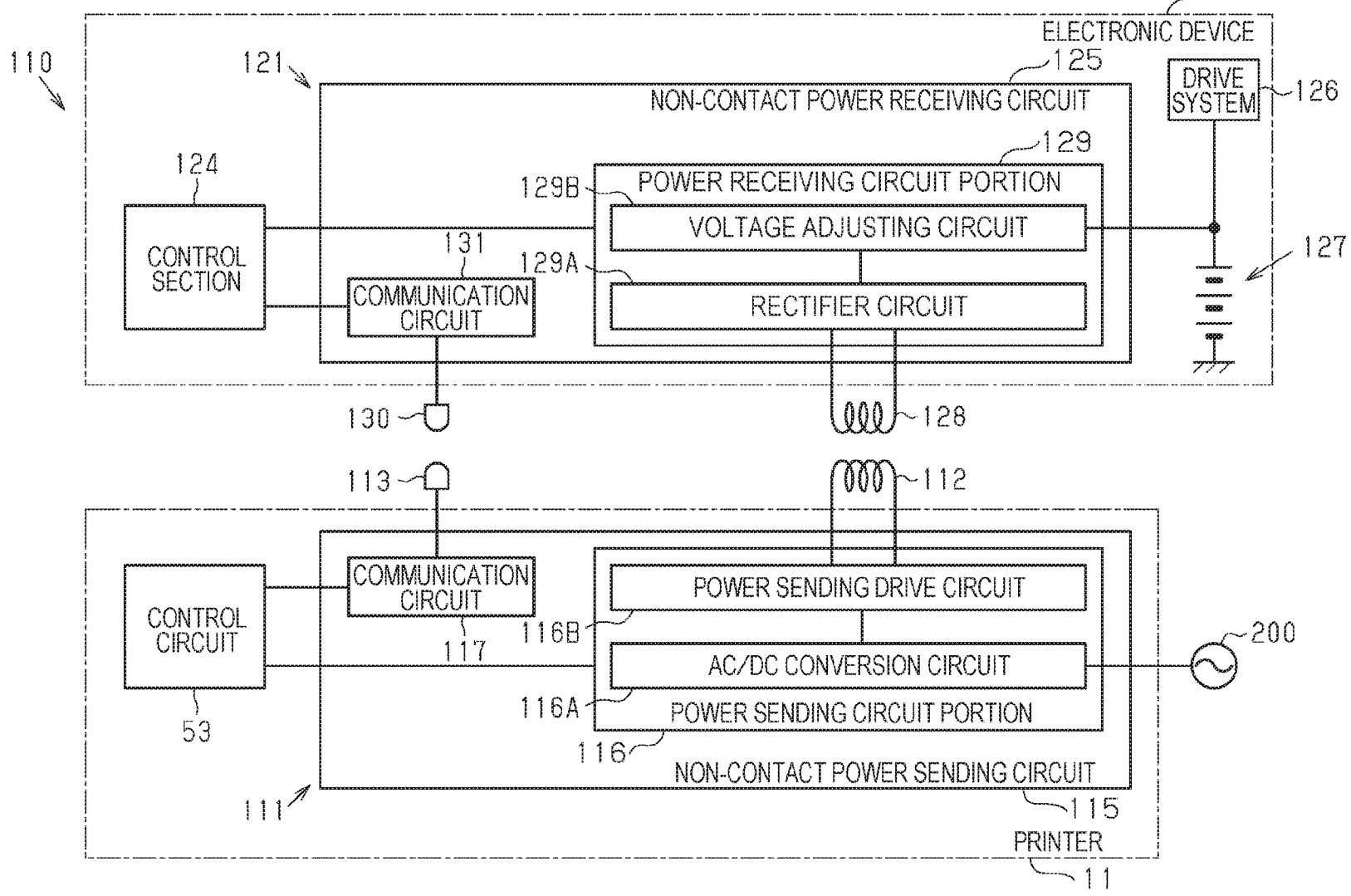
FIG. 19 is a block diagram illustrating an electrical configuration of a power supply system in the liquid ejecting system.

As illustrated in FIG. 19, the printer 11 includes the control circuit 53 and the non-contact power sending circuit 115 as an example of the power transmission section. The non-contact power sending circuit 115 includes a power sending circuit section 116 and a communication circuit 117. The power sending circuit section 116 includes an AC/DC conversion circuit 116A (AC/DC converter) that converts AC power at a commercial AC power source 200 into DC power at a predetermined voltage and a power sending drive circuit 116B that converts the DC power at the predetermined voltage output from the AC/DC conversion circuit 116A into a current at a predetermined frequency and supplies the current to the power sending section 112 (power sending coil). The communication circuit 117 performs communication processing including generation of a transmission signal to be transmitted by the communication section 113 and conversion of a signal received by the communication section 113 into a signal that can be processed by the control circuit 53. The power sending circuit section 116 and the communication circuit 117 are controlled by the control circuit 53. An external component (an AC/DC adaptor, for example) that is connected to the commercial AC power source 200 outside the printer 11 may be used instead of the AC/DC conversion circuit 116A.

As illustrated in FIG. 19, the electronic device 120 includes a control section 124, a non-contact power receiving circuit 125, a drive system 126, and a battery 127. The non-contact power receiving circuit 125 includes a power receiving section 128 to which the power receiving circuit section 129 (power receiving coil) is connected and a communication circuit 131 to which the communication section 130 is connected.

The power receiving circuit section 129 includes a rectifier circuit 129A that rectifies a current in a first frequency band (power transmission frequency band F2) received by the power receiving section 128 and a voltage adjustment circuit 129B that adjusts (boosts, for example) the current rectified by the rectifier circuit 129A to have a predetermined voltage. The battery 127 is charged with the current at the predetermined voltage output by the voltage adjustment circuit 129B. The communication circuit 131 performs communication processing including generation of a transmission signal to be transmitted by the communication section 130 for communication between the communication sections 113 and 130 and conversion of a signal received by the communication section 130 into a signal that can be processed by the control section 124. The power receiving circuit section 129 and the communication circuit 131 are controlled by the control section 124.

If the electronic device 120 is installed on the installation surface section 12B of the printer 11, for example, the control circuit 53 receives a request for supplying power from the electronic device 120 through communication between the communication sections 24 and 34. The control circuit 53 receives the request for supplying power, and then performs one of drive signal generation and power transmission, for which a request has been received, if timing at which the drive signal generation processing is performed does not overlaps timing at which the power transmission processing is performed. In contrast, the control circuit 53 performs exclusive control of performing one of the drive signal generation processing and the power transmission processing with priority and restricting the other if the timing at which the drive signal generation processing is performed overlaps the timing at which the power transmission processing is performed.

If it is not necessary to perform the exclusive control when the request for supplying power is received, for example, the control circuit 53 starts non-contact power supply between the power sending section 112 and the power receiving section 128 by driving the power sending circuit section 116 of the non-contact power sending circuit 115 and supplying the current at the predetermined frequency to the power sending section 112. When the charging of the electronic device 120 is completed and a request for stopping power supply is received through communication between the communication sections 113 and 130 and when it becomes necessary to stop power supply for the exclusive control, the control circuit 53 stops driving the power sending circuit section 116 of the non-contact power sending circuit 115. As a result, the supply of the current at the predetermined frequency to the power sending section 112 is stopped, and the non-contact power supply between the power sending section 112 and the power receiving section 128 is stopped.

The control circuit 53 performs the exclusive control of driving one of the drive signal generation circuit 58 and the non-contact power sending circuit 115 with priority and restricting the driving of the other in a case where driving timing of the drive signal generation circuit 58 overlaps driving timing of the non-contact power sending circuit 115 (power sending unit 111).

When the driving timing of the drive signal generation circuit 58 overlaps the driving time of the non-contact power sending circuit 115, the control circuit 53 performs the exclusive control in the following two ways. One of the ways is a case where the drive signal is generated by the drive signal generation circuit 58 with priority and the power sending by the non-contact power sending circuit 115 is restricted, and the other is a case where the power sending by the non-contact power sending circuit 115 is performed with priority and the generation of the drive signal by the drive signal generation circuit 58 is restricted.

In the case where one of the drive signal generation circuit 58 and the non-contact power sending circuit 115 is driven with priority and the driving of the other is restricted in the exclusive control, the other is restricted in a way in which the driving is stopped or in a way in which the content of the driving is switched from ordinary content to partially restricted content.

According to the embodiment, the printer 11 includes the non-contact power sending circuit 115, the power is transmitted from the power sending section 112 to the power receiving section 128 in a non-contact manner, and the battery 127 of the electronic device 120 is charged with the power. If the electronic device 120 is installed on the installation surface section 12B of the printer 11, the control section 124 on the side of the electronic device 120 provides a request for supplying power to the control circuit 53 on the side of the printer 11 through communication between the communication sections 130 and 113. The control circuit 53 on the side of the printer 11 receives the request for supplying power from the control section 124 and then drives the non-contact power sending circuit 115. As a result, the power sending circuit section 116 is driven, and power is supplied from the power sending section 112 to the power receiving section 128 in a non-contact manner.

According to the embodiment, power transmission and restriction of the power transmission are performed by controlling the driving of the non-contact power sending circuit 115 by the control circuit 53 on the side of the printer 11 provided with the non-contact power sending circuit 115. Here, the control circuit 53 on the side of the printer 11 performs power sending as the power transmission.

The exclusive control of placing priority on the drive signal generation processing is the same as that in the flowchart illustrated in FIG. 14 in the first embodiment, and the exclusive control of placing priority on the power transmission processing is the same as that in the flowchart illustrated in FIG. 15 in the first embodiment. Although the exclusive control is different from that illustrated in FIGS. 14 and 15 in that the request for transmitting power is received from the electronic device 120 and the power transmission and the restriction of the power transmission are performed by controlling the non-contact power sending circuit 115 provided in the printer 11 by the control circuit 53, basic processing content of the exclusive control is the same as that in FIGS. 14 and 15.

If the timing at which the drive signal generation processing overlaps the timing at which the power transmission processing a case where the exclusive control is performed in accordance with the flowchart in FIG. 14, exclusive processing of performing the drive signal generation processing with priority is performed. As a result, it is possible to suppress inappropriate charging (power supply) such as excessive charging and insufficient charging and inappropriate generation of the drive signal due to resonance or the like that can occur in a case where the frequency band for transmitting power and the frequency band for generating the waveform of the drive signal at least partially overlap each other. The driving of the non-contact power sending circuit 115 is stopped or the non-contact power sending circuit 115 is driven in the frequency band restricted such that used frequency bands do not overlap each other when the drive signal generation circuit 58, on which the priority is placed in the exclusive control, is being driven. It is possible to maintain the charging of the battery 127 and to perform the printing based on the received print job even if the battery 127 of the electronic device 120 is being charged with the power transmitted by the printer 11 in the restricted frequency band as described above.

If the timing at which the drive signal generation processing is performed overlaps the timing at which the power transmission processing is performed in the case of performing the exclusive control in accordance with the flowchart in FIG. 15, the exclusive control of performing the power transmission processing with priority is performed. As a result, it is possible to suppress in appropriate charging (power supply) such as excessive charging and insufficient charging due to resonance or the like that can occur in a case where the frequency band for forming the waveform of the drive signal and the frequency band for transmitting power at least partially overlap each other. The drive signal generation circuit 58 is stopped, or the frequency band used by the drive signal generation circuit 58 for forming the waveform is restricted to the restricted frequency even if the request for generating the drive signal is received when the non-contact power receiving circuit 57, on which the priority is to be placed in the exclusive control, is being driven or if the drive signal is being generated when the request for transmitting power is made by the electronic device 120. As a result, the frequency band for transmitting power and the frequency band for generating the waveform of the drive signal do not overlap each other, and it is possible to avoid inappropriate charging (power supply) such as excessive charging and insufficient charging and in appropriate generation of the drive signal due to resonance or the like. In a case where the driving of the drive signal generation circuit 58 in the restricted frequency band is continued, it is possible to maintain the charging of the battery 19 and to perform the printing based on the drive signal COM with the waveform generated at the restricted frequency.

Although the second embodiment as described above is different from the first embodiment in the configuration in which the printer 11 includes the non-contact power sending circuit 115 as an example of the non-contact power transmission circuit instead of the non-contact power receiving circuit 57 in the first embodiment and the printer transmits power to the electronic device 120, the same effects as the effects (1) to (17) described above in the first embodiment can be achieved. In addition, the following effects can be achieved.

(19) The printer 11 includes the non-contact power sending circuit 115 that supplies power to the electronic device 120 as an example of the apparatus outside the liquid ejecting apparatus. If the electronic device 120 including the non-contact power receiving circuit 125 is installed on the installation surface section 12B of the printer 11, it is possible to transmit power from the printer 11 to the electronic device 120 in a non-contact manner and to charge the electronic device 120.

(20) The liquid ejecting system 110 includes the printer 11 and the electronic device 120. The printer 11 includes the power sending section 112 provided in the non-contact power sending circuit 115, and the electronic device 120 includes the power receiving section 128 that receives power supply from the power sending section 112 in a non-contact manner. The power sent from the power sending section 112 of the printer 11 can be supplied to the power receiving section 128 of the electronic device 120 in a non-contact manner. Accordingly, it is possible to charge the electronic device 120 with the power supplied from the printer 11.

The aforementioned embodiments can be modified in the following forms.

The liquid ejecting system may include the power supply device 30 provided with the non-contact power sending circuit 36 according to the first embodiment and the printer as an example of the liquid ejecting apparatus that functions both as the power receiving unit 22 according to the first embodiment and as the power sending unit 111 according to the second embodiment. According to the liquid ejecting system, it is possible to charge the printer 11 by using the power supply device 30 and to charge the electronic device 120 provided with the power receiving unit 121 by using the power sending unit 111 (non-contact power sending circuit 115) of the printer 11.

In the exclusive control, which of the drive signal generation processing and the power transmission processing is to be performed with priority may be changed in accordance with a situation at that time. For example, one of the drive signal generation processing and the power transmission processing to be performed with priority may be determined in accordance with the printing mode, or may be determined in accordance with the battery charging capacity. If the printing mode is the draft mode, for example, the non-contact power transmission circuit is driven with priority, and the drive signal generation circuit is driven in the restricted frequency band. In contrast, if the printing mode is the high-definition mode, the drive signal generation circuit is driven with priority, and the driving of the non-contact power transmission circuit is stopped, or the non-contact power transmission circuit is driven in the restricted frequency band. If the battery charging capacity is equal to or less than a threshold value, for example, the non-contact power transmission circuit is driven with priority, and the drive signal generation circuit is driven in the restricted frequency band. In contrast, if the battery charging capacity exceeds the threshold value, the drive signal generation circuit is driven with priority, and the driving of the non-contact power transmission circuit is stopped, or the non-contact power transmission circuit is driven in the restricted frequency band.

Although in the case where one of the drive signal generation and the power transmission is performed with priority and the other is restricted by stopping the other or changing the frequency band used by the other in the exclusive control described above, signal intensity or electromagnetic wave intensity used by the other may be lowered. That is, exclusive control of lowering the intensity used by the other as compared with that in a non-restricted case when priority is placed on one of the exclusive control targets may be performed. That is, the restriction includes the stopping of the driving, the switching of the frequency band, and the lowering of the intensity.

It is only necessary for the drive signal frequency band F1 (second frequency band) to be partially included in the power transmission frequency band F2 (first frequency band). In such a case, the example in which the entirety of the first frequency band is included in the second frequency band (FIG. 11) or the example in which only a part of the first frequency band is included in the second frequency band (FIG. 12) is also applicable. However, an example in which a part of the first frequency band is included in the second frequency band by a configuration in which the first frequency band is wider than the second frequency band and the entirety of the second frequency band is included in the first frequency band is also applicable.

The invention may be applied to the Qi standard as another international standard of wireless charging instead of A4WP Rezence (registered trademark) as the wireless charging standard based on the magnetic field resonance (also referred to as resonance transformation, resonance electromagnetic coupling, or resonance charging). The Qi standard is an international standard of wireless power supply defined by Wireless Power Consortium (WPC). The standard for low power of equal to or less than 5 W for mobile phones and smart phones has been defined.

Other electric field resonance schemes may be used as the on-contact power supply scheme. Examples thereof may include an electromagnetic resonance scheme, an electromagnetic induction scheme, a radio wave receiving scheme, a microwave power sending scheme, and a laser power transmitting scheme.

The non-contact power receiving circuit 57 may be arranged in the accommodation space SA1, and the drive signal generation circuit 58 may be arranged in the accommodation space SA2.

The first surface and the second surface are not limited to the two surfaces that face in the width direction of the case body 12. The first surface and the second surface may be two surface that face in a direction parallel to the transport direction Y of the case body 12, for example. The drive signal generation circuit 58 is arranged at a position closer to the first surface than to the second surface, and the non-contact power receiving circuit 57 as an example of the non-contact power transmission circuit is arranged at a position closer to the second surface than to the first surface. In such a case, the first surface represents one of the third surface 43 (front surface) and the fourth surface (rear surface), and the second surface represents one of the third surface 43 and the fourth surface. With such a configuration, it is possible to arrange the drive signal generation circuit 58 and the non-contact power receiving circuit 57 so as to be separate from each other and to thereby achieve the same effects. In such a case, the drive signal generation circuit 58 and the non-contact power receiving circuit 57 may be arranged in the different accommodation spaces SA1 and SA2, and both the circuits 57 and 58 may be arranged at opposing corners in the case body 12. Alternatively, both the circuits 57 and 58 may be arranged in the same accommodation space in the accommodation spaces SA1 and SA2. Furthermore, the first surface and the second surface may be the fifth surface 45 and the sixth surface 46 that face in the height direction (vertical direction) of the case body 12.

At least one of the feeding motor 17 and the transport motor 18 as transport system power sources may be provided as a power source accommodated with one of the non-contact power receiving circuit 57 and the drive signal generation circuit 58 in the same accommodation space.

Although the exclusive control is performed such that the control circuit 53 drives one of the non-contact power receiving circuit 57 and the drive signal generation circuit 58 with priority and the driving of the other is restricted in the aforementioned embodiments, the exclusive control may be abandoned. Even if the non-contact power receiving circuit 57 and the drive signal generation circuit 58 are driven at the same time, it is possible to suppress electrical resonance such as resonance as long as one of both circuits 57 and 58 is arranged at the position closer to the first surface than to the second surface and the other circuit is arranged at the position closer to the second surface than to the first surface in the case body.

The liquid ejecting apparatus may eject liquid other than ink. As states of the liquid ejected from the liquid ejecting apparatus as a significantly small amount of liquid droplets, a particle shape, a tear-drop shape, and a shape with a threadlike tail are included. The liquid described herein may be any materials that can be ejected from the liquid ejecting apparatus. For example, any materials may be used as long as the materials are in a liquid phase state, and a fluid with high or low viscosity, a sol, a gel solution, other inorganic solvents, organic solvents, solution, a fluid such as liquid resin are included. The materials are not limited to liquid as one state of the materials, materials obtained by dissolving, dispersing, or mixing particles made of solid substances such as a pigment are also included. In a case where the liquid is ink, the ink includes typical water-based ink, oil-based ink, and various liquid compositions such as gel ink and hot-melt ink. The liquid ejecting apparatus may be a textile printing apparatus or a microdispenser, for example.

The invention may be applied to a speaker device provided with a drive signal generation circuit including a digital amplifier for generating an acoustic drive signal for driving the speaker and an acoustic device that includes at least one of a power receiving unit provided with a non-contact power receiving circuit and a power sending unit provided with a non-contact power sending circuit as an example of the non-contact power transmission unit. In the case of applying the invention to such an acoustic device, the control circuit performs the exclusive control between the non-contact power transmission circuit and the drive signal generation circuit, drives one of the non-contact power transmission circuit and the drive signal generation circuit with priority, and restricts the other, for example. In the acoustic device, a predetermined range from 10 Hz to 100 kHz, for example, is used as the frequency band (second frequency band) for the drive signal. In the case of transmitting power in a non-contact manner in the first frequency band that is at least partially included in the second frequency band, it is possible to suppress in appropriate charging such as excessive charging and deteriorate of acoustic quality due to electrical interference such as resonance.

What is claimed is:

1. A liquid ejecting apparatus comprising:

a liquid ejecting section that ejects liquid in response to a drive signal;

a drive signal generation circuit that generates the drive signal by using a second frequency band including at least a part of a first frequency band;

a non-contact power transmission circuit that transmits power in a non-contact manner by using the first frequency band; and a control circuit that controls the drive signal generation circuit and the non-contact power transmission circuit, wherein the control circuit restricts the generation of the drive signal by the drive signal generation circuit in a case where the non-contact power transmission circuit has transmitted the power.

2. The liquid ejecting apparatus according to claim 1, further comprising:

a case body that surrounds the drive signal generation circuit and the non-contact power transmission circuit and includes a first surface and a second surface that faces the first surface, wherein the drive signal generation circuit is arranged at a position closer to the first surface than to the second surface, and wherein the non-contact power transmission circuit is arranged at a position closer to the second surface than to the first surface.

3. The liquid ejecting apparatus according to claim 1, wherein the non-contact power transmission circuit transmits the power from an apparatus outside the liquid ejecting apparatus to the liquid ejecting apparatus.

4. The liquid ejecting apparatus according to claim 1, wherein the non-contact power transmission circuit transmits the power from the liquid ejecting apparatus to an apparatus outside the liquid ejecting apparatus.

5. The liquid ejecting apparatus according to claim 1, wherein the drive signal generation circuit includes an amplifier circuit using a digital amplifier.

6. The liquid ejecting apparatus according to claim 1, wherein the second frequency band includes a frequency in a band from 1 MHz to 8 MHz.

7. The liquid ejecting apparatus according to claim 1, wherein under the restriction, the drive signal is generated without using the first frequency band.

8. The liquid ejecting apparatus according to claim 7, wherein under the restriction, the frequency band used for generating the drive signal is switched.

9. The liquid ejecting apparatus according to claim 7, wherein under the restriction, the generation of the drive signal is stopped.

10. The liquid ejecting apparatus according to claim 1, wherein a draft mode in which dots formed by the liquid ejecting section ejecting the liquid have first resolution and a high-definition mode in which the dots have second resolution that is higher than the first resolution are provided, and wherein the control circuit restricts the generation of the drive signal by the drive signal generation circuit in the draft mode and does not restrict the generation of the drive signal in the high-definition mode in a case where the non-contact power transmission circuit has transmitted the power.

11. A liquid ejecting system comprising:

the liquid ejecting apparatus according to claim 1; and a power supply device, wherein the liquid ejecting apparatus includes a power receiving section, and the power supply device includes a power sending section that sends power to the power receiving section in a non-contact manner.

12. A liquid ejecting system comprising:

the liquid ejecting apparatus according to claim 2; and a power supply device, wherein the liquid ejecting apparatus includes a power receiving section, and the power supply device includes a power sending section that sends power to the power receiving section in a non-contact manner.

13. A liquid ejecting system comprising:

the liquid ejecting apparatus according to claim 3; and a power supply device, wherein the liquid ejecting apparatus includes a power receiving section, and the power supply device includes a power sending section that sends power to the power receiving section in a non-contact manner.

14. A liquid ejecting system comprising:

the liquid ejecting apparatus according to claim 4; and a power supply device, wherein the liquid ejecting apparatus includes a power receiving section, and the power supply device includes a power sending section that sends power to the power receiving section in a non-contact manner.

15. A liquid ejecting system comprising:

the liquid ejecting apparatus according to claim 5; and a power supply device, wherein the liquid ejecting apparatus includes a power receiving section, and the power supply device includes a power sending section that sends power to the power receiving section in a non-contact manner.

16. A liquid ejecting system comprising:

the liquid ejecting apparatus according to claim 6; and a power supply device, wherein the liquid ejecting apparatus includes a power receiving section, and the power supply device includes a power sending section that sends power to the power receiving section in a non-contact manner.

17. A liquid ejecting system comprising:

the liquid ejecting apparatus according to claim 7; and a power supply device, wherein the liquid ejecting apparatus includes a power receiving section, and the power supply device includes a power sending section that sends power to the power receiving section in a non-contact manner.

18. A liquid ejecting system comprising:

the liquid ejecting apparatus according to claim 8; and a power supply device, wherein the liquid ejecting apparatus includes a power receiving section, and the power supply device includes a power sending section that sends power to the power receiving section in a non-contact manner.

19. A liquid ejecting system comprising:

the liquid ejecting apparatus according to claim 9; and a power supply device, wherein the liquid ejecting apparatus includes a power receiving section, and the power supply device includes a power sending section that sends power to the power receiving section in a non-contact manner.

20. A liquid ejecting system comprising:

the liquid ejecting apparatus according to claim 1; and an electronic device, wherein the liquid ejecting apparatus includes a power sending section in the non-contact power transmission circuit, and the electronic device includes a power receiving section that receives power supply from the power sending section in a non-contact manner.

* * * * *